US005146631A

United States Patent [19]

Deal

[11] Patent Number: 5,146,631

[45] Date of Patent: Sep. 15, 1992

[54] CONVERTIBLE CRIB, TODDLER AND TWIN BED

[75] Inventor: Harry Deal, Newark, Del.

[73] Assignee: Simplicity Inc., Wyncote, Pa.

[21] Appl. No.: 754,569

[22] Filed: Sep. 4, 1991

[51] Int. Cl.[5] ..... A47D 7/00

[52] U.S. Cl. ..... 5/93.2; 5/53.1; 5/183; 5/285

[58] Field of Search ..... 5/93.1, 93.2, 53.1, 5/8, 21, 183, 185, 281, 280, 285, 201, 907

[56] References Cited

U.S. PATENT DOCUMENTS

| | | | |
|---|---|---|---|
| 335,360 | 2/1886 | Jenkens | 5/93.1 |
| 584,699 | 6/1897 | McCoy | 5/53.1 |
| 1,193,272 | 8/1916 | Laforest . | |
| 2,223,955 | 12/1940 | Greenbaum | 5/93 |
| 2,677,832 | 5/1954 | Christensen | 5/285 |
| 2,783,477 | 3/1957 | Tittsworth | 5/2.1 |
| 3,225,364 | 12/1965 | Miret | 5/93.1 |
| 3,383,718 | 5/1968 | Spencer | 5/93.1 |
| 3,821,822 | 7/1974 | Borreggine | 5/109 |
| 4,361,919 | 12/1982 | Hull | 5/93 |
| 4,525,883 | 7/1985 | Necowitz | 5/93 |
| 4,763,368 | 8/1988 | Lucero | 5/93 |
| 4,856,127 | 8/1989 | Lenger | 5/53.1 |
| 5,038,427 | 8/1991 | Golden | 5/93.2 |

FOREIGN PATENT DOCUMENTS

| | | | |
|---|---|---|---|
| 356277 | 2/1990 | European Pat. Off. | 5/93.2 |

OTHER PUBLICATIONS

Meubles Meg, Inc. Catalog, Jul. 1, 1991, p. 16 Item No. CB9104R, p. 20, Item No. B771.

*Primary Examiner*—Renee S. Luebke
*Assistant Examiner*—F. Saether
*Attorney, Agent, or Firm*—Louis Weinstein

[57] ABSTRACT

A convertible bed assembly for providing a crib, toddler bed, or twin bed arrangement and alternatively a pair of twin or bunk beds. A pair of headboard and footboard assemblies each have separable upper and lower sections mounted together through coupling hardware to provide a crib assembly having one stationary crib side rail and one drop side rail. Motifs are releasably coupled to the top of the headboard and footboard assemblies through hardware. Any one of a variety of different motifs may be mounted upon the headboard and footboard assemblies. The crib is converted into a toddler bed by removing the lower sections of the headboard and footboard assemblies and replacing the fixed and drop sides of the crib with toddler safety rails joined to the upper sections and which are preferably stored beneath the crib posture board to provide convenient access at the time of conversion. The drop side and fixed side hardware is utilized in a unique fashion to mount each of the toddler safety rails. The crib or toddler bed arrangement is readily converted into a conventional twin bed having a headboard or a pair of twin or bunk beds through the use of conversion side pieces which mount directly to upper sections of the headboard and footboard assemblies and have side rails bolted thereto for forming a single twin bed, or conversion side pieces which are mounted to the upper and lower sections to form two twin beds or bunk beds each having a headboard and a footboard, or conversion side pieces and twin bed frame bolted thereto to provide two identical twin beds without footboards.

27 Claims, 16 Drawing Sheets

*Fig. 1a*
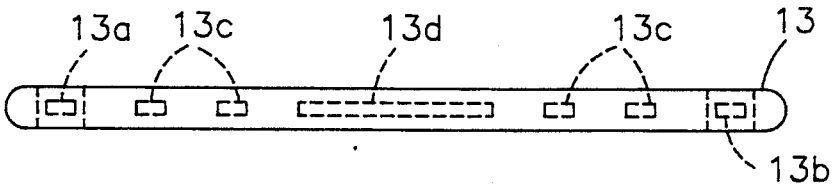
*Fig. 1b*
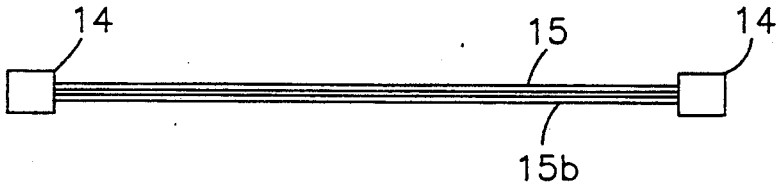
*Fig. 1c*
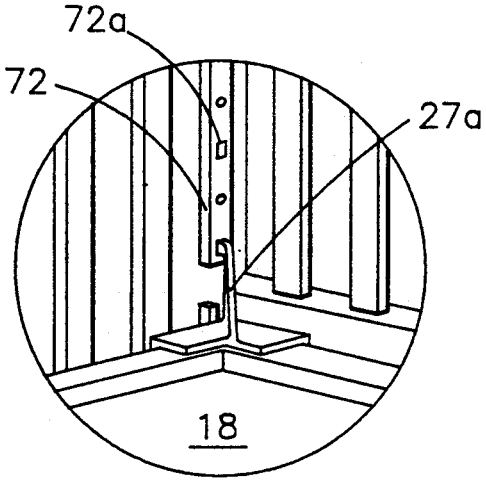
*Fig. 1c-1*
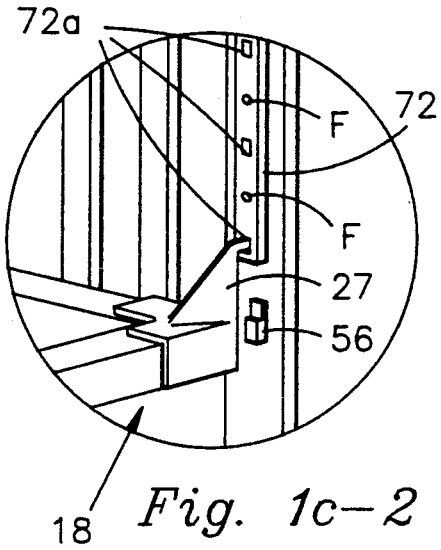
*Fig. 1c-2*

CONVERTIBLE CRIB, TODDLER AND TWIN BED

FIELD OF THE INVENTION

The present invention relates to children's beds and, more particularly, to a novel bed design which is rapidly and easily convertible from a crib, to a toddler bed, to one or two twin beds and being further designed to accommodate a wide variety of motifs.

BACKGROUND OF THE INVENTION

Cribs are conventionally utilized as sleeping means for infants, typically from birth to an age of 2 to 3 years. Conventional cribs are designed from the viewpoint of both convenience and safety and typically provide headboards and footboards, as well as left and right sides which are of sufficient height to prevent any infant from climbing out of the crib and to encourage the infant to stand and grip the crib sides, if necessary, while preventing the child from falling out of the crib. At least one of the sides is movable between a locked upper position and a lowered position to facilitate placement or removal of the child from the crib by the parent, for example. The crib mattress is adjustably arranged to be of a height so that the supporting surface of the crib mattress permits the infant to be placed upon the mattress or removed therefrom without undue bending by the person attending to the infant, while being a sufficient distance below the top sides of the crib to prevent an infant from falling or climbing out.

The above safety and convenience features are typically incorporated into conventional crib designs. Many of these features are inconvenient when the infant reaches an age where he/she outgrows a crib. For example, once the child can satisfactorily perform the functions of sitting, climbing and walking, for example, the crib sides become an inconvenience. In addition, even though the child has mastered the activities of climbing up or down from a surface, such as a bed or crib to the floor, it is nevertheless disadvantageous to have a child occupy a crib totally unprotected by the crib sidewalls due to the danger of falling.

It thus becomes a practical necessity to replace the child's crib with a toddler bed which provides features not found in a crib and which further encourages the child to become more independent by developing less of a dependency upon the safety features of a crib which are necessarily provided to protect infants, but are no longer necessary to protect a toddler and hence become a matter of inconvenience to the toddler. Nevertheless, it is advantageous to provide safety rails designed to prevent the child from accidentally falling out of the bed when sleeping, for example, while at the same time being designed to encourage the child to climb into and out of the toddler bed.

As a result, it becomes necessary to replace the crib with a toddler bed to meet the requirements of the growing child.

In much the same way that an infant outgrows a crib, the toddler eventually outgrows the toddler bed necessitating still another change in which the toddler bed is typically replaced by a twin bed.

All of the above changes are both costly and inconvenient and it is thereby extremely advantageous to provide a bed structure which is capable of "growing with the child", and at a significantly reduced cost.

In addition to the above, cribs and beds of the type described are typically available in a wide variety of styles and/or motifs to attract the widest range of potential customers. This is extremely disadvantageous from the point of view of retailers and wholesalers, as well as crib manufacturers. The disadvantage from the point of view of retailers and wholesalers is that a large amount of space is required for inventory. This problem is further compounded for the retailer who requires a large amount of display space in order to be assured that the customer is made fully aware of the wide range of available designs. In a similar manner, the manufacturer is required to produce a wide variety of bed designs thereby complicating the manufacturing process. It is therefore extremely advantageous to provide a bed design incorporating as many common components as is practical, while providing additional components having design motifs which are adaptable to the variety of tastes and likings of the potential purchasing public.

BRIEF DESCRIPTION OF THE INVENTION

The present invention achieves all of the above objectives and eliminates the disadvantages of conventional bed and crib designs by a design which is characterized by comprising headboard and footboard assemblies which are substantially identical to one another and are comprised of a pair of side posts and a top rail. The crib design is provided with a pair of crib rails. One of the crib rails is preferably stationary in use and is fixedly secured to associated side posts of the headboard and footboard to enhance structural strength, while the remaining crib rail is movable up and down and is capable of being locked in the upper position, while at the same time being easily released from the exterior side of the crib rail.

The headboard and footboard assemblies are formed into two sections, i.e., an upper and a lower section. The upper section is mechanically coupled to the lower section which, while providing rigid coupling, may be easily taken apart for conversion to a toddler and a twin size bed. The upper and lower sections collectively form a frame having a groove for supporting a panel which provides a solid look between the upper and lower sections of the headboard and footboard assemblies.

The upper sections of the headboard and the footboard each include an integral top rail. A motif portion has a similar shaped rail supported on the top rail and rigidly mechanically coupled thereto by concealed self-locking hardware which provides excellent metal-to-metal securement. The motifs are provided with different designs which are adapted to meet different tastes of the purchasing public and may, for example, include a traditional design, modern design, feminine design, masculine design and so forth, the motifs being easily interchangeable with the associated headboard and footboard whose basic design remains unchanged.

The side posts of the headboard and footboard assemblies are provided with brackets to facilitate adjustment of the mattress posture board to accommodate the growth and height of the child.

As the child's growth development progresses, the crib may be easily and readily converted into a toddler bed at the appropriate time simply by releasing the coupling members joining the upper and lower sections of the headboard and footboard assemblies whereby the bottom of the headboard and footboard end posts serve as a means for supporting the toddler bed which is significantly reduced in overall height by removal of the lower section thereby placing the mattress board and hence the mattress at a safe (reduced) height above the floor to significantly reduce the potential for injury.

The crib side rails are replaced with toddler bed safety rails which have a position of reduced height to facilitate easy access to the toddler bed while the remainder of the toddler safety rail is of a height which protects the toddler from rolling out of the bed. The movable side rail hardware and the stationary side rail hardware are utilized to mount the toddler safety rails. The removal of the lower section of the headboards and footboards reduces the height of the mattress board and the mattress and places it at a safe height for use by toddlers.

The toddler side rails are conveniently stored beneath the mattress board and all of the necessary hardware is in place on the crib arrangement. The drop side and stationary side hardware are utilized in a unique fashion to serve the dual function of mounting both the drop side and stationary side crib rails and the toddler safety rails which replace the drop side and stationary side rails.

In much the same manner as the child progresses from the crib to the toddler bed, the toddler bed may be easily converted to a twin bed or, alternatively, the crib may be converted directly to a twin bed, if desired.

Initially considering the conversion of the crib arrangement to a twin bed, the lower sections of the headboard and footboard assemblies are removed and the fill-in panels are likewise removed whereby the upper sections of the headboard and footboard assemblies serve as the basic support structures for the twin bed. This operation may have already been performed in converting the crib to a toddler bed. The headboards and footboards are now the proper height of a conventional twin bed. A pair of side posts are then locked to each of the end posts of the headboard and footboard upper sections. Twin bed conversion side rail pieces are then bolted to the side posts of the headboard and footboard upper sections. The conversion pieces cooperate with the headboard and footboard upper sections to yield a bed of proper twin bed width in order to accommodate a conventional twin bed box spring and mattress. The headboard and footboard upper sections provide a twin bed of conventional height. The side rails are mounted to the conversion pieces so as to be of a height sufficient to store a trundle bed beneath the twin bed. The twin size spring and mattress are supported upon the side rails in conventional manner. As an alternative, the headboard and footboard may each be fitted with conventional frames for supporting a spring and mattress to provide a pair of twin beds.

The lower sections may also be combined with footboard conversion pieces to serve as a footboard of shorter height than the upper section (employed as the headboard) to provide a pair of twin beds each having a headboard and a footboard assembly.

The crib, toddler bed or twin bed may each further be adorned with a motif construction which transforms the basic crib into different styles by the addition of a motif piece provided with a bottom rail supported by the top rail of the upper section of each headboard and footboard, the motif component being joined to each of the headboard and footboard upper sections by concealed coupling members which rigidly secure each motif member to its associated headboard and footboard through a rugged metal-to-metal coupling. The motif members are provided with a variety of different styles, shapes and patterns to yield a plurality of aesthetically pleasing arrangements to accommodate a variety of different tastes.

The convertible crib/toddler/twin bed design has a simplicity which lends itself to easy assembly, even by a novice, and which significantly simplifies and reduces the complexity of manufacturing techniques, as well as inventory problems.

The uniqueness of the design of the present invention is such that the components of the bed, absent the motif, are arranged within a single carton, while the motif is packaged in an independent carton. Since the crib structure is typically the initial bed arrangement utilized by the purchaser, the components for the crib/toddler/twin bed arrangements are packaged such that the components necessary for assembling the crib arrangement are provided within one portion of a first carton, while the components necessary for converting the crib arrangement to a twin bed are assembled within a second carton, which occupies the remaining portion of the first carton. The components utilized to convert the crib arrangement into a toddler bed arrangement are likewise assembled within the carton containing the components necessary for the crib arrangement and, in addition, are mounted so as to be stored beneath the underside of the assembled crib where they are substantially fully concealed from view and yet easily accessible when needed to convert the crib arrangement into a toddler bed. Thus, the components necessary for converting the crib arrangement (or toddler bed) into a twin bed may be conveniently stored within the aforementioned second carton until ready for use.

By arranging the motif member within a separate carton, it is possible to provide a purchaser with all of the components which make up a crib/toddler/twin bed kit in one carton which contains all of the components excluding the motif containing all the common kit parts. The twin bed conversion components are housed in a second carton within the main carton to facilitate storage until needed. Thus, even assuming that a purchaser desires a motif which is not in stock, such customer can still be provided with all of the common components necessary to erect any of the three bed arrangements (i.e., crib, toddler or twin bed) enabling the customer to immediately enjoy the use of the bed of the purchaser's choice while awaiting delivery of the desired motif. It should be noted that the absence of the motif does not in any way degrade the safety features of the crib and/or toddler bed arrangement which is designed to meet all the minimum federal safety requirements even in the absence of the motif. The large variety of motifs may be displayed separately from the convertible bed arrangements significantly reducing the amount of display space required.

OBJECTS OF THE INVENTION

It is therefore one object of the present invention to provide a novel bed design which permits simple rapid conversion from one type of bed arrangement to another by a rearrangement and/or elimination and/or addition of components, said design lending itself to easy assembly which even a novice can perform.

Another object of the present invention is to provide a convertible bed or crib having a design which lends itself to economic manufacture.

Still another object of the present invention is to provide a novel convertible bed arrangement in which the conversion is not easily noticeable.

Still another object of the present invention is to provide a convertible bed arrangement in which the components and hardware employed for rigidly securing the bed components to one another are concealed beneath one of the bed arrangements to enhance the aesthetic appearance of the assembled structure and being readily accessible for converting the bed arrangement.

Another object of the present invention is to provide a convertible bed assembly which in the disassembled state may be conveniently packed for shipping and storage in a minimum of space.

Still another object of the present invention is to provide a convertible bed arrangement comprising components adequate for assembling any one of the crib, toddler, or twin bed arrangement and wherein the components necessary for converting the bed arrangement from a crib to a toddler bed are mounted directly onto a portion of the crib so that they are concealed from view and yet easily accessible when needed to convert the crib arrangement to a toddler bed.

Still another object of the present invention is to provide a novel convertible bed design incorporating components which permit the assembly of a bed arrangement which may be combined with any one of a variety of releasably mounted motifs to suit any one of a variety of different tastes.

Still another object of the present invention is to provide a novel convertible bed design incorporating components which permit the assembly of a bed arrangement which may be combined with any one of a variety of releasably mounted motifs to suit any one of a variety of different tastes and wherein the common components and motifs are packaged independently of one another to facilitate and simplify manufacturing, storage and inventory control.

Still another object of the present invention is to provide a novel convertible bed arrangement capable of being assembled to form any one of a crib, toddler and twin bed wherein the components for the crib and toddler bed are arranged within a main package and wherein the components necessary for conversion to a twin bed are arranged within a separate package within the main package and which is sufficiently compact to require a minimum of storage space until needed.

Still another object of the present invention is to provide a novel convertible bed arrangement utilizing headboard and footboard assemblies which are designed to be easily and readily convertible into a crib, toddler bed and either one or a pair of twin beds, or bunk beds, and will provide adequate space for a trundle bed.

Still another object of the present invention is to provide a novel convertible bed arrangement capable of being assembled to form any one of a crib, toddler and twin bed wherein the components for the crib and toddler bed are arranged within a main package and wherein the components necessary for conversion to a twin bed are arranged within a separate package within the main package and which is sufficiently compact to require a minimum of storage space and wherein the components necessary for converting the crib to a toddler bed and which are contained within the same package as the crib components are releasably secured to the assembled crib in a manner such that they are easily accessible even though concealed from view.

BRIEF DESCRIPTION OF THE FIGURES

The above, as well as other objects of the present invention will become apparent from reading the accompanying description and drawings in which:

FIG. 1*a* is a plan view of the top rail of the headboard assembly of FIG. 1.

FIG. 1*b* is a bottom view of the upper section of the headboard assembly shown in FIG. 1.

FIG. 1*c*, comprised of magnified views identified as FIG. 1*c*-1 and FIG. 1*c*-2, show a detailed perspective view showing the manner in which one corner of the posture board assembly is mounted to a post plate provided on the headboard assembly and further showing a female coupling means utilized for joining a crib stationary side rail thereto.

FIG. 1*d* shows a perspective view of the posture board assembly.

FIGS. 1*d*-1 through 1*d*-4 show enlarged views of the mounting hooks provided in each of the corners of the posture board shown in FIG. 1*d*.

FIG. 2 shows an elevational view of a crib rail employed in the crib arrangement of the invention.

DETAILED DESCRIPTION OF THE INVENTION AND THE PREFERRED EMBODIMENTS THEREOF

Figure 1:
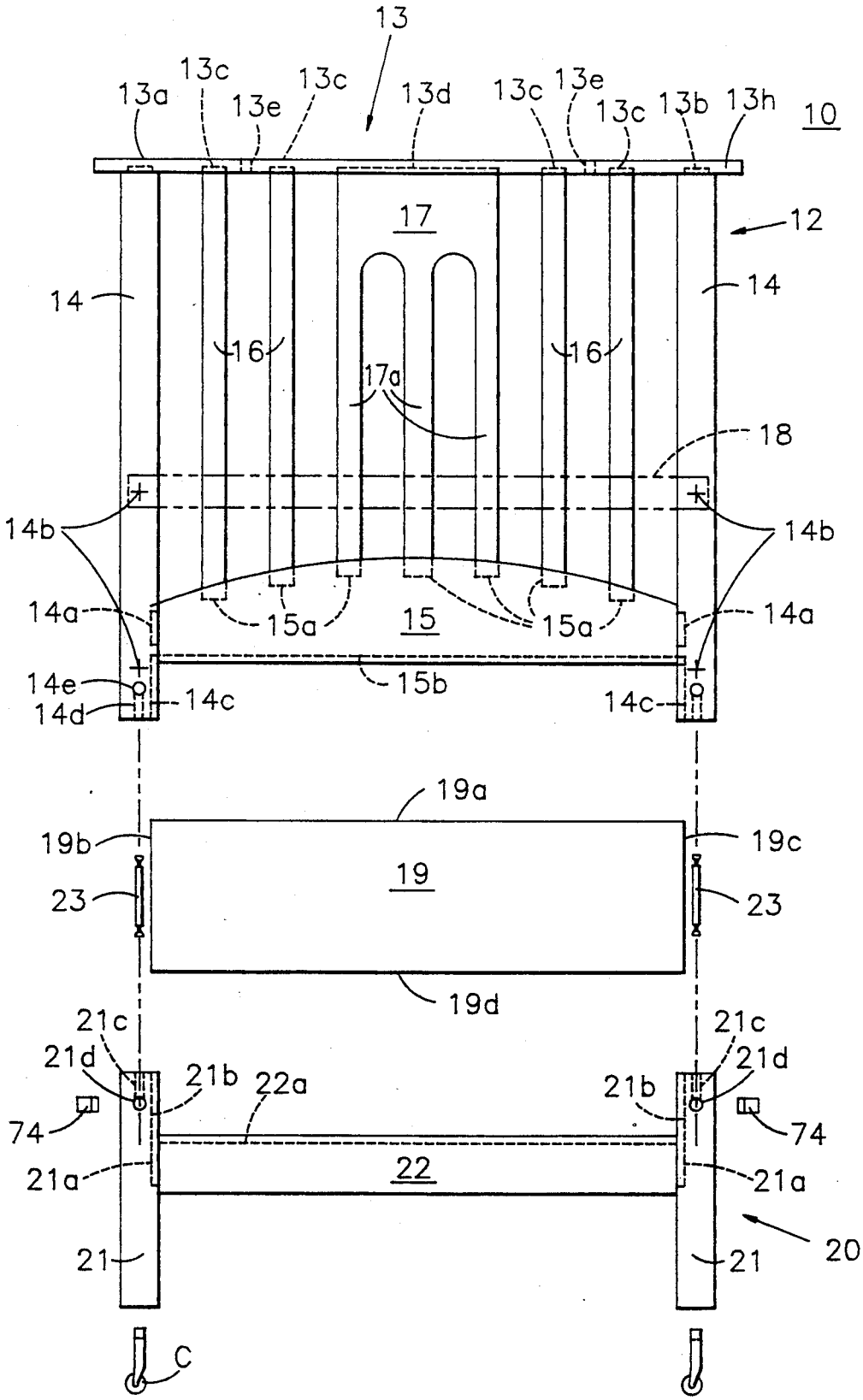
FIG. 1 shows an exploded elevational view of a headboard assembly, embodying the principles of the present invention.

FIG. 1 shows a headboard assembly embodying the principles of the present invention. It should be noted that the footboard assembly is substantially identical to the headboard assembly and as a result, only a description of the headboard assembly will be given herein for purposes of simplicity.

The headboard assembly 10 is comprised of an upper section 12 and a lower section 20. Upper section 12 includes a pair of side or end posts 14, 14 joined together at their top ends by means of a top rail 13 and joined together near their bottoms by means of a board 15. The top ends of posts or legs 14 are provided with tenons or projections which extend into associated mortises **13*a*, 13*b* provided along the underside of top rail 13. A suitable glue or adhesive may be provided to retain the interfitted members in the assembled condition. Board 15 is likewise provided with similar tenons which extend into associated mortises 14*a*, 14*a* provided along the interior facing sides of legs 14, 14. A plurality of vertically aligned slats 16 extend into associated mortises 13*c* provided along the underside of top rail 13, as well as mortises 15*a* provided along the top curved surface of board 15**.

A centerpiece 17 having a continuous upper edge which is inserted into elongated mortise **13*d*, forms a fork-like structure having three slat-like portions 17*a* extending downwardly with their bottom ends extending into associated mortises 15*a* provided in the top edge of board 15**.

Legs 14, 14 are each provided with a plurality of spaced pre-drilled bores **14*b* each adapted to receive threaded fastener members F for fastening a post plate 72** one of which is shown in FIG. 1*c* and is provided with a plurality of slots **72*a* for receiving a hook 27*a* from a posture board 18** to be more fully described and as shown in FIG. 1*c*. The slots **72*a* are utilized for adjusting the height of the posture board 18 shown also in dotted fashion in FIG. 1 as being secured by hooks 27*a* in one of the cooperating slots 72*a***.

The underside of board 15 is provided with an elongated groove **15*b* which cooperates with grooves 14*c*, 14*c* arranged along the inner, facing sides of the bottom portions of end posts 14, 14, which grooves have a depth and width similar to the groove 15*b* in order to accommodate the upper end 19*a* and the upper portions of side edges 19*b*, 19*c* of panel 19** which will be described more fully hereinbelow.

Lower section 20 of headboard assembly 10 is comprised of a pair of legs 21, 21 having a cross-sectional shape conforming to legs 14, 14. The legs 21, 21 are joined by a board 22 having tenons which engage associated mortises **21*a*, 21*a* provided in legs 21, 21. The upper edge of board 22 is provided with elongated groove 22*a*. Cooperating grooves 21*b*, 21*b* are provided in the upper portion of each leg 21, 21. The grooves 15*b*, 14*c*–14*c*, 21*b*–21*b* and 22*a* all cooperate to receive the top left-hand, right-hand and bottom edges 19*a*–19*d* respectively of panel 19 when the top and bottom sections 12 and 20 are assembled together. The panel 19 enhances the solid appearance of the assembled headboard 10. In the preferred embodiment, a ⅛th inch thick panel is utilized to fit into the grooves 15*b*, 14*c*–14*c*, 21*b*–21*b* and 22*a* to yield the appearance of a solid structure which enhances the sturdy look of the assembled crib. Casters C may be mounted within pre-drilled holes provided at the bottom end of each of the legs 21**.

Figure 1E:
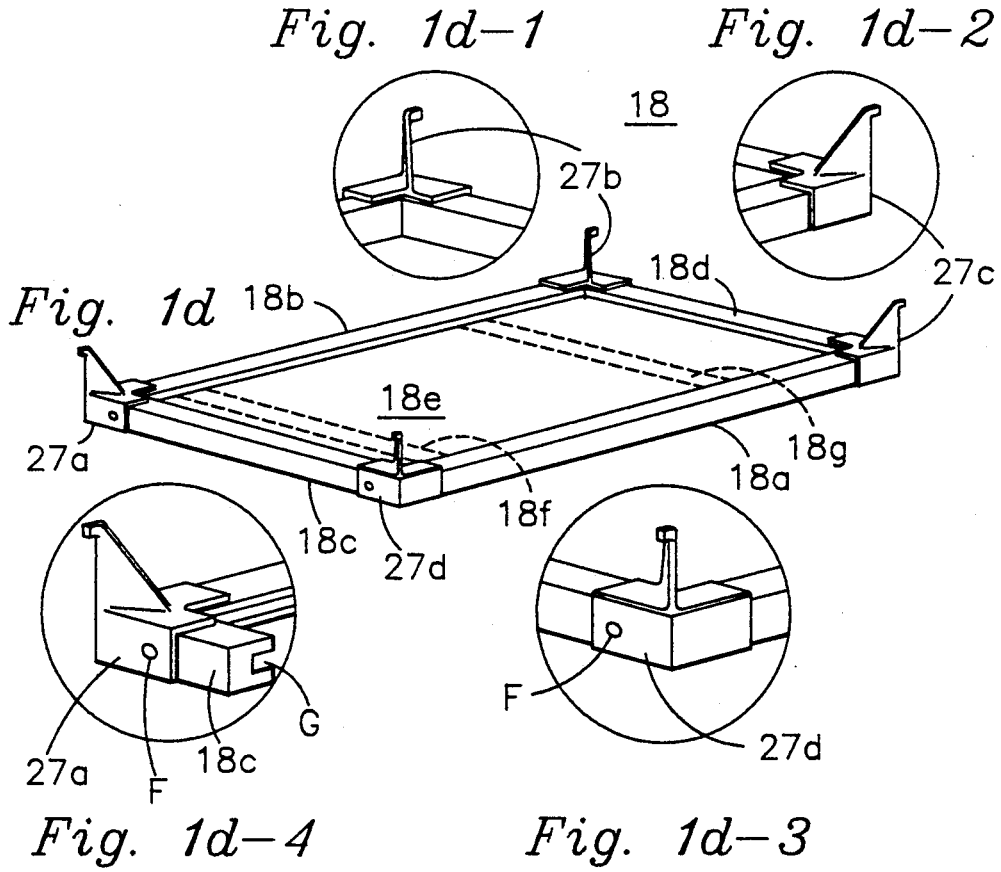
FIG. 1*e* shows an exploded view of the cam stud and cam lock members utilized to join the upper and lower sections of the headboard and footboard assemblies.
Figure 1E:
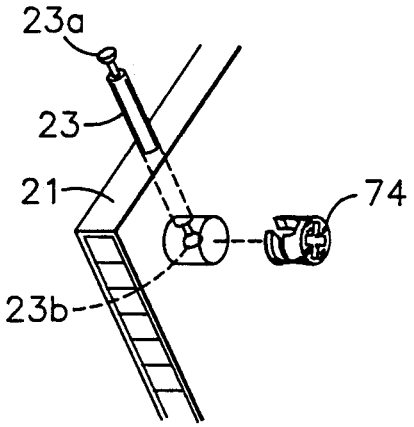

Each lower leg 21 is rigidly and securely fastened to each upper leg 14 by means of a cam stud 23 shown in FIGS. 1 and 1*e* which is inserted into the vertically aligned bores **14*d* and 21*c* of upper and lower legs 14 and 21. Cam locks 74, 74 as shown in FIG. 1 are inserted into bores 14*e* and 21*d* provided in legs 14 and 21 and arranged so that they communicate with bores 14*d* and 21*c***, respectively, and are arranged at right angles thereto.

FIG. 1*e* shows an exploded view of the cam stud and cam locks employed.

The cam stud is inserted in the bores **21*c*, 21*c* and 14*d*, 14*d*, the upper lower sections 12 and 20 being pushed together so that the bottom surface of each leg 14 engages the top surface of an associated leg 21. Thereafter, the cam locks 74, 74 are inserted into the bores 14*e*, 14*e* and 21*d*, 21*d* and are then rotated through approximately a one-quarter (¼) turn to lock the upper and headboard sections 12 and 20 to one another. Each cam lock 74 captures an enlarged head 23*a*, 23*b* of the cam stud 23 within a C-shaped opening which embraces an associated head 23*a*, 23*b* when rotated through a one-quarter (¼) turn to lock the upper and lower sections 12 and 20**.

The upper and lower sections may easily be disassembled from one another in a similar fashion for purposes of converting the crib to a toddler bed or twin bed, as will be more fully described, simply by rotating the cam locks 74, 74 in the reverse direction.

FIG. 1*d* shows a perspective view of a posture board 18 comprised of sides **18*a*, 18*b* and ends 18*c*, 18*d* joined to form a frame. Each corner of the frame is provided with a hook assembly 27*a*–27*d* secured to each corner of the posture board by a threaded fastener F. The hooks are mounted within one of the slots 72*a* provided in post plates 72** to support the posture board at the desired height (see FIG. 1*c*). The posture board includes a flat board **18*e* arranged within grooves provided in each frame piece 18*c*–18*d*. Note, for example, groove G in end piece 18*a*. The board 18*e*, preferably formed of Masonite, replaces a conventional mattress spring, serving to suitably support a mattress (not shown) while eliminating staining of the mattress due to the rusting of the spring which is typical in conventional structures. The posture board design also eliminates the danger of the child getting his/her fingers pinched between the mattress and standard spring-type support. A pair of bracing pieces 18*f*, 18*g* are secured to the underside of frame assembly 18** to enhance the structural strength of the frame.

Figure 2:
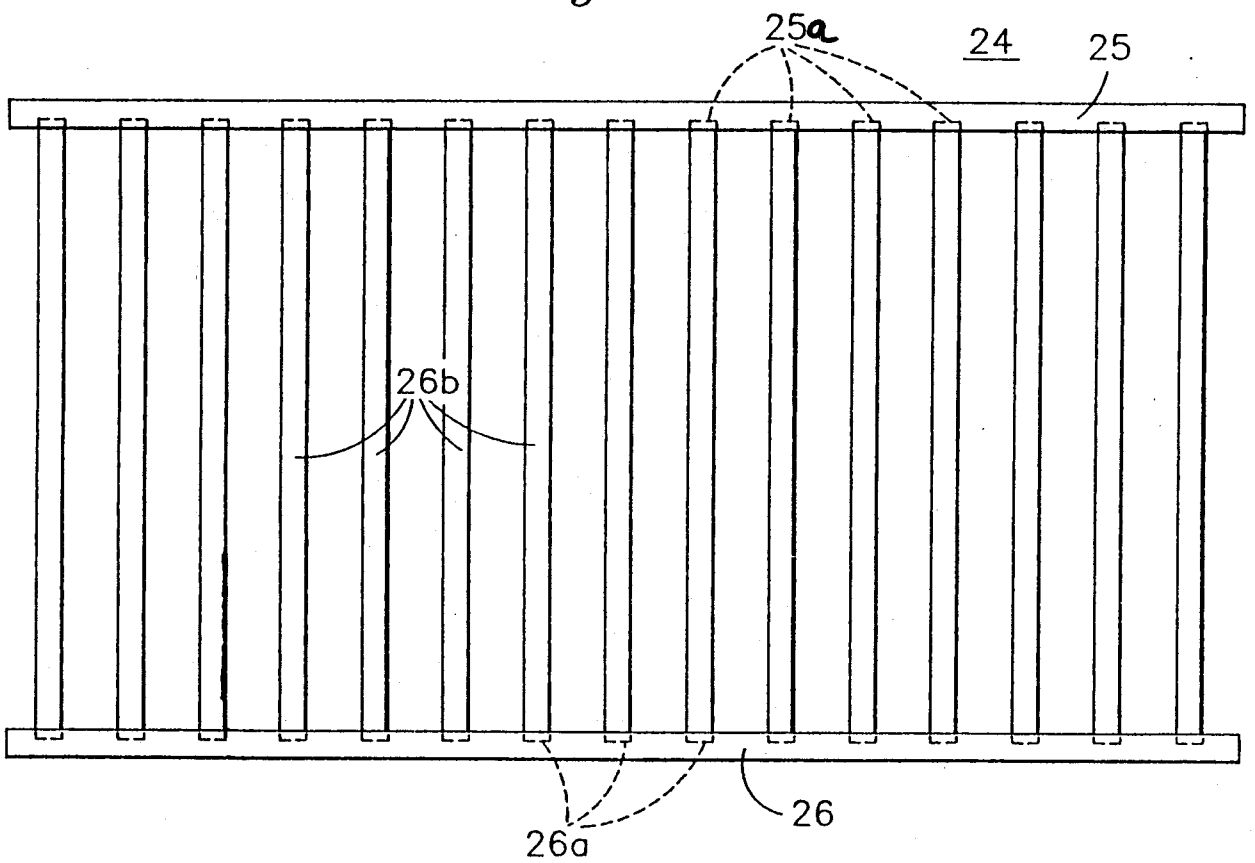

FIG. 2 shows an elevational view of one of the crib rails of the present invention, it being understood that both crib rails are substantially identical to one another and hence only one crib rail will be described herein for purposes of simplicity.

Crib rail 24 is comprised of a pair of elongated upper and lower rail members 25, 26 each provided with a plurality of mortises 25*a*, 26*a* for receiving upper and lower edges of slats 26*b*. A suitable glue, epoxy or other material may be used to enhance the structural strength of each joint.

Figure 1F:
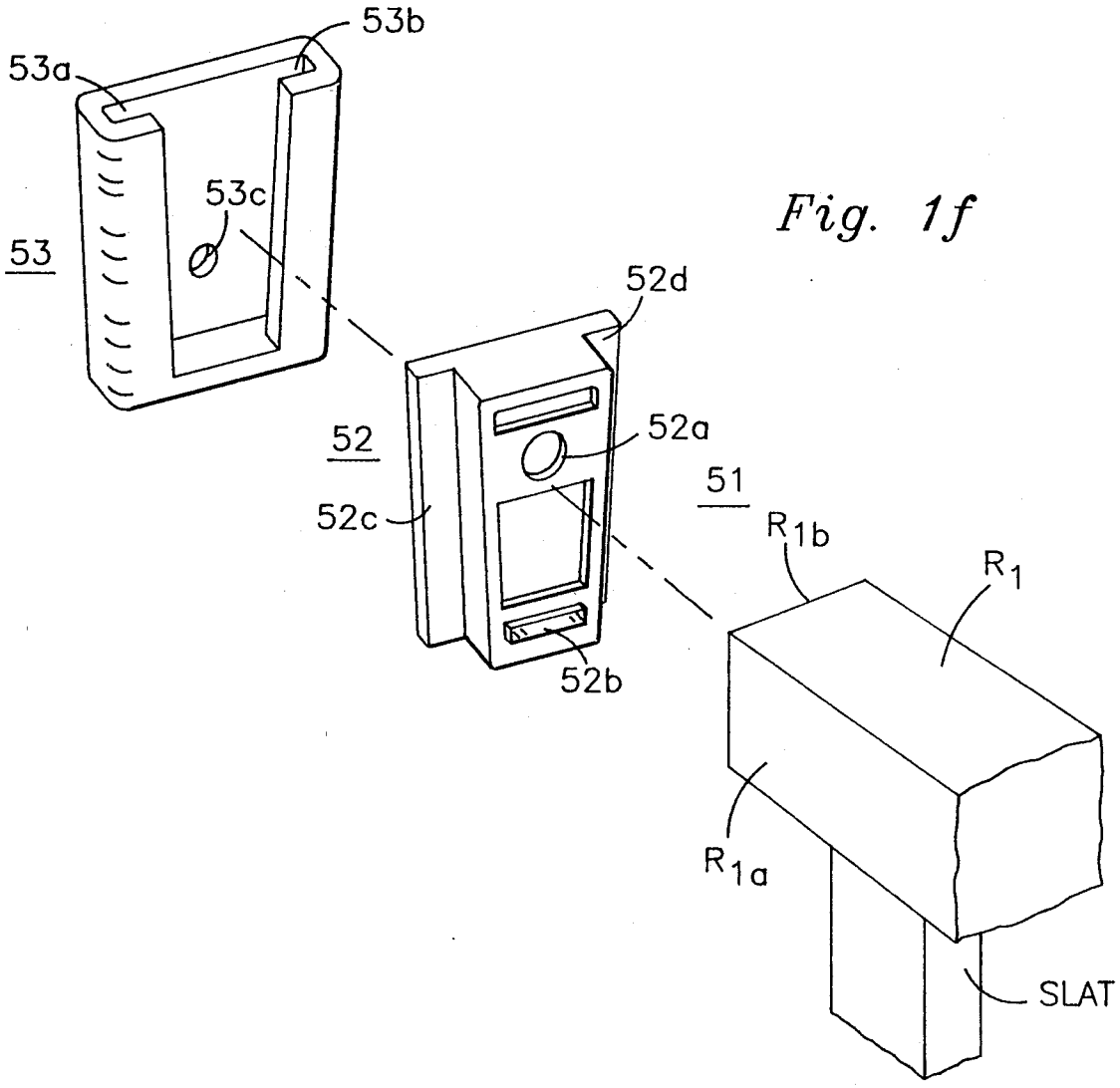
FIG. 1*f* shows an exploded perspective view of the upper locking assemblies for mounting the fixed crib safety rail.
Figure 1G:
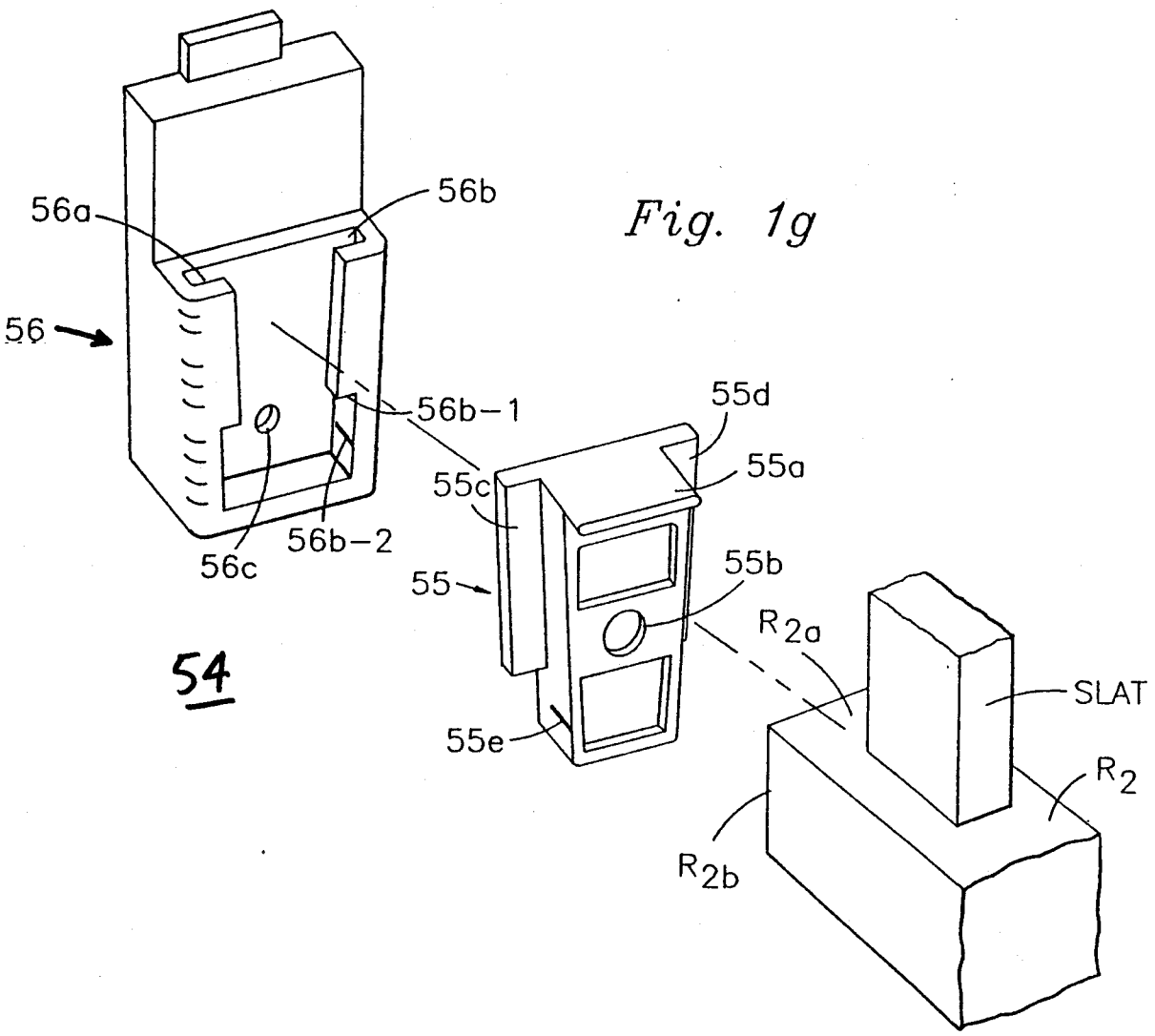
FIG. 1*g* shows an exploded perspective view of the lower locking assembly for mounting crib safety rail.

One of the crib rails is securely fastened to associated legs 14 of the headboard and footboard assemblies and remains stationary in use, assuring a strong, sturdy construction. The stationary crib side rail assembly 24 is secured to associated legs of a headboard and footboard assembly by means of releasable locking assemblies 51, 54 shown in exploded perspective fashion in FIGS. 1*f* and 1*g*. Releasable locking assembly 51 shown in FIG. 1*f* comprises male and female members 52 and 53. Male member 52 is mounted to the end of upper rail R1 by a suitable threaded fastener extending through opening 52*a*. Projection 52*b* rests against the underside R1*a* of rail R1 to prevent the male member 52 from rotating once mounted upon the end surface R1*b*. The free end of male member 52 projects outwardly and away from end R1*b* and is provided with a pair of outwardly directed flanges 52*c*, 52*d* adapted to be slidably received within the undercut grooves 53*a*, 53*b* of female member 53 which is provided with an opening 53*c* for receiving a threaded fastener to secure female member 53 to one of the side posts 14 (see FIG. 1). As can be seen, both the male and female members have tapering shapes with wider upper ends tapering down to narrow lower ends to facilitate guidance and insertion of member 52 into member 53.

The locking assembly 54 is somewhat similar to assembly 51 except that the projection 55*a* of male member 55 is provided at the upper end thereof in order to rest against the upper surface R2*a* of the crib bottom rail member R2. In a similar fashion opening 55*b* receives a threaded fastener to secure member 55 against the left-hand end R2*b* of lower rail R2, projection 55*a* resting against upper surface R2*a* to prevent the male member 55 from rotating. Male member 55 is provided with a pair of outwardly directed flanges 55*c*, 55*d* which are slidably received within undercut grooves 56*a*, 56*b* of female member 56. The grooves 56*a*, 56*b* terminate at a location such as 56*b*-1 a spaced distance above the bottom end of the female member providing a flat surface 56*b*-2 extending from the bottom of groove 56*b*-1 to the bottom end of the female member. Projections such as, for example, the projection 55*e* arranged just below the flange 55*c* engage the flat surface to "lock" the male member within the female member. The members 55 and 56 have a tapered configuration similar to the members 52 and 53, respectively.

Figure 2A:
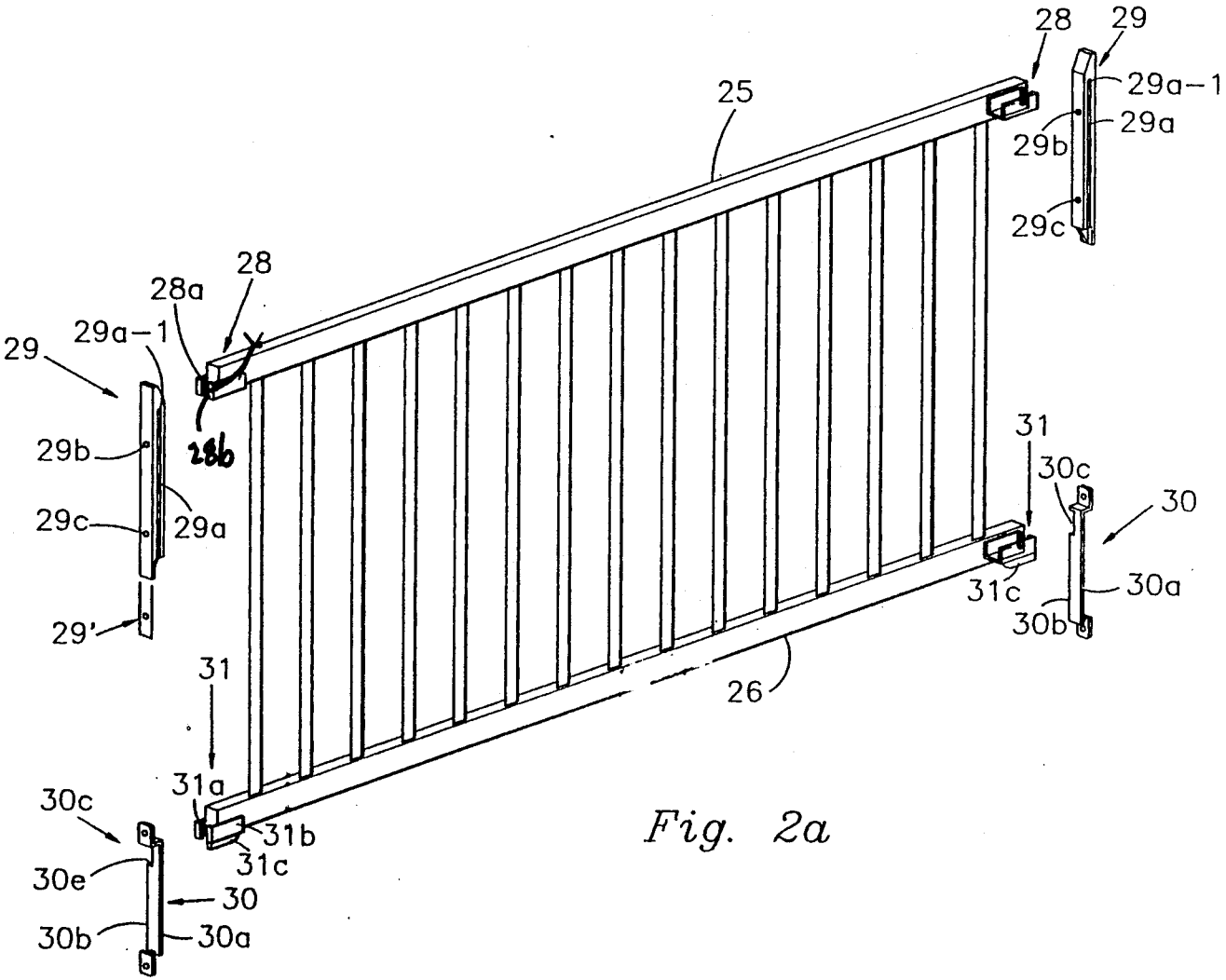
FIG. 2*a* shows an exploded perspective view of a drop side crib rail employed in the present invention.

The remaining crib rail is slidably mounted to the remaining side posts of the headboard and footboard assemblies in the manner shown best in FIG. 2*a*. The upper rail 25 is provided with a pair of upper guards 28, 28 secured to the left and right-hand ends of the upper rail. A pair of cooperating upper tracks 29, 29 are secured along the interior facing edges of associated side posts of a headboard and a footboard assembly, which has been omitted from FIG. 2*a* for purposes of simplicity. Each upper track is provided with track grooves 29*a*, 29*a* along opposite parallel sides, only one of said sides being visible in FIG. 2*a*. The inwardly directed flanges 28*a*, 28*b* of each upper guide 28 are slidably received within the guide grooves 29*a* of the tracks 29.

Lower track assemblies 30, 30 are mounted along the interior facing surfaces of the headboard and footboard end posts and are substantially aligned with and spaced a vertical distance downwardly from the upper tracks 29, 29. Each of the lower tracks is provided with an outer continuous guide surface 30*a* and an inner guide surface 30*b* that is substantially continuous and linear over its length and which is provided with a notched portion 30*c* near the upper end thereof. A pair of lower guide assemblies 31, 31 are secured to opposite ends of the lower crib rail 26 and are each provided with a pair of guide projections 31*a*, 31*b* with inwardly turned free ends, said guide projections being slidable along the cooperating guide surfaces 30*b*, 30*a*, respectively.

Spring-loaded biasing lever 31*c* is pivotally mounted to the lower guide 31 and is urged by a bias spring (not shown) so that its lower edge presses against guide surface 30*a* causing the guide projections 31*c* to move outwardly and away from guide surface 30*a* and urging guide projections 31*a* toward engagement with guide surface 30*b*. As the guide 31 is moved upwardly along the lower track assembly 30, when the guide projection 31*a* is aligned with notch 30*c*, spring-loaded lever 31*c* moves the lower guide assembly outwardly moving projection 31*a* into notch 30*c*. The lower end of notch 30*c* extends diagonally downward, causing projection 31*a* to rest against the bottom edge 30*e*, locking the sliding side into the upright position. It should be understood that both lower guide assemblies and their cooperating tracks operate in substantially identical fashion.

The slidable crib side may be lowered by gripping the top rail 25, for example, to raise the top rail so that the projections 31*a*, 31*a* of the lower guide are lifted off the inclined surfaces 30*e*, 30*e*. By pressing the lower rail 26 near the center thereof, for example, by pressing against a plate (not shown) marked "PUSH", the lower guides are moved inwardly against the force of levers 31*c*, 31*c* to move the projections 31*a*, 31*a* out of notch 30*c* at which time the crib side rail may be lowered, projections 31*a*, 31*a* sliding along the associated guide surfaces 30*b*, 30*b*.

Figure 2B:
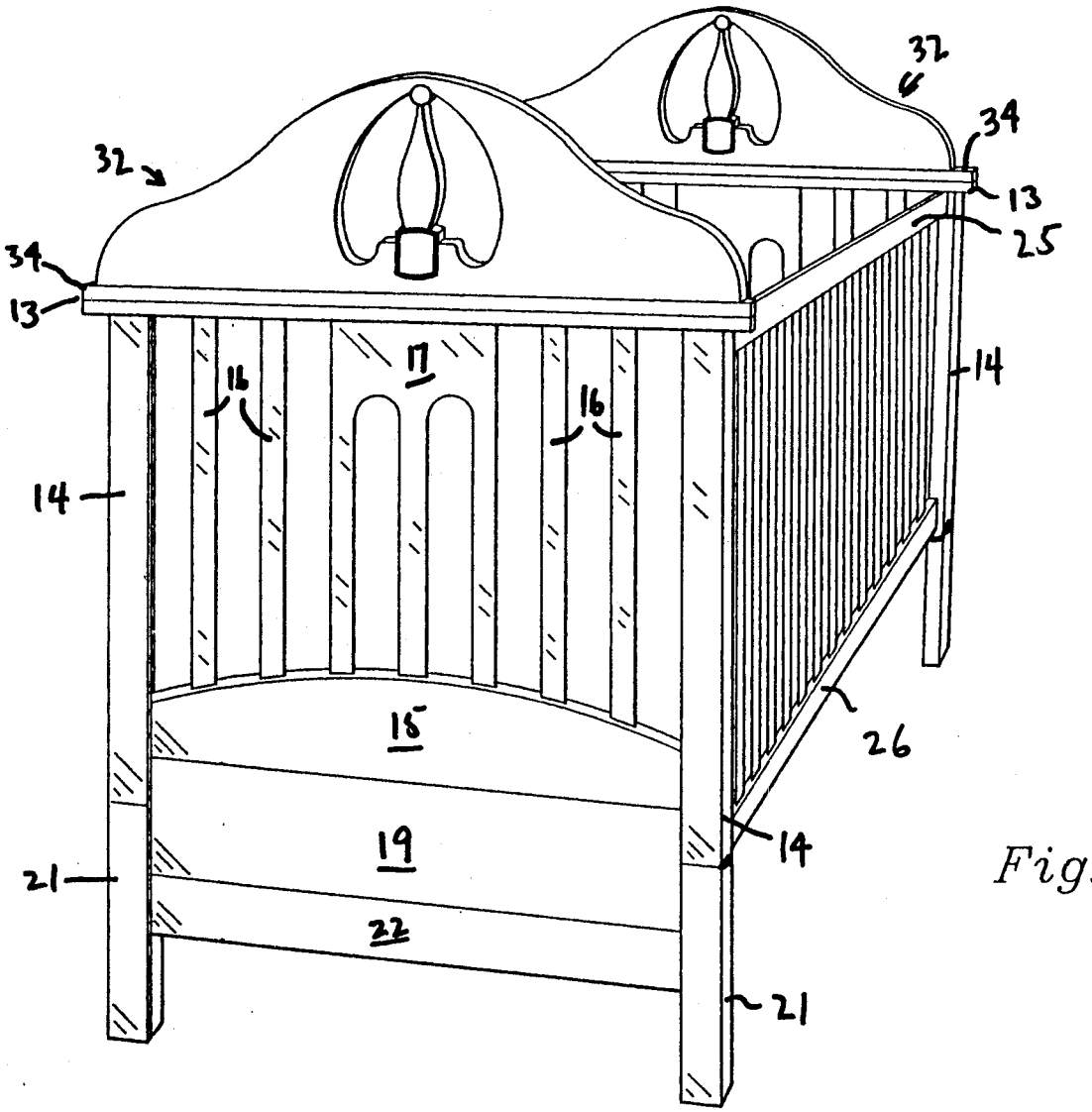
FIG. 2*b* is a perspective view of an assembled crib with a motif.
Figures 3A, 3B, 3C, 3D:
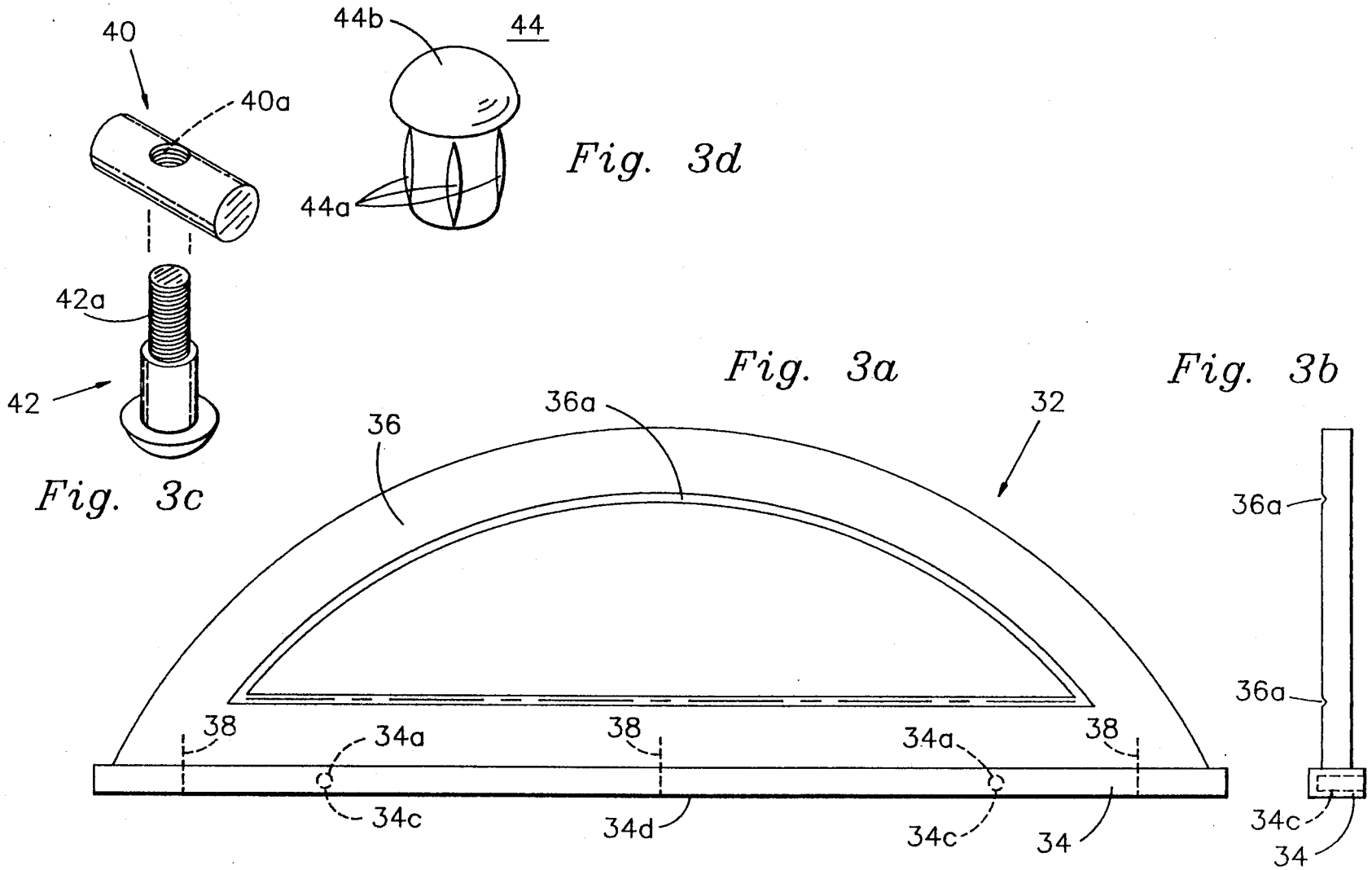
FIGS. 3*a* and 3*b* respectively show side and end views of a motif of the type shown in FIG. 2*b*.
FIG. 3*c* shows an exploded perspective view of the mounting hardware employed for mounting the motif to the headboard top rail.
FIG. 3*d* shows a perspective view of a cover cap employed to cover blind holes in components of the convertible bed arrangement to enhance the aesthetic appearance thereof.

FIG. 2*b* is a perspective view showing a fully assembled crib arrangement which is designed to meet all governmental safety requirements. The aesthetic appearance of the crib may be enhanced considerably through the employment of motifs shown, for example, in FIGS. 3*a*, 3*e* and 3*f*, as well as FIG. 2*b*. FIGS. 1 and 1*a* show the top rail 13 of the headboard top section 12 which is provided with a pair of openings for receiving a shoulder screw 42, for securing a motif thereto. FIGS. 3*a* and 3*b* show a side and end view of motif 32 having a bottom rail 34 at its base which is joined to a curved member 36 provided with an aesthetically pleasing V-groove 36*a* formed therein. Base 34 is joined to curved member 36 by threaded fasteners located at the dotted line positions 38 shown in FIG. 3*a*. Rail 34 is provided with a pair of horizontally aligned elongated openings 34*a* which communicate with one side 34*b* of base 34. A second pair of openings 34*c* communicate with the bottom surface 34*d* of base rail 34 and with each of the openings 34*a*. A cross-dowel 40 shown in the perspective view of FIG. 3*c* is inserted into each of the openings 34*a*, 34*a* so that its threaded opening 40*a* is aligned with opening 34*c*. A shoulder screw 42 is inserted through the underside of each of the openings 13*e*, 13*e* provided in the top rail 13 shown in FIG. 1. The threaded portion 42*a* of shoulder screw 42 threadedly engages the tapped opening 40*a* in cross-dowel 40 providing a simple, but yet solid metal-to-metal securement construction. In addition, the self-locking bolts 42, as well as the cross-dowels 40 are concealed when installed and fully assembled so that they do not detract from the aesthetic appearance. In addition, cover caps such as, for example, cover cap 44 shown in FIG. 3*d* may be inserted into the opening of the blind holes, such as hole 34*a*. The cover cap 44 is provided with either a ribbed or lightly tapered body (see ribs 44*a*) to insure a secure grip within a blind hole when installed. The cover cap, although preferably made of plastic, has at least head portion 44*b* which is of a color which blends nicely with the color of the motif rail 34. A motif may be mounted in substantially the identical fashion on both the headboard and footboard.

Figure 3F:
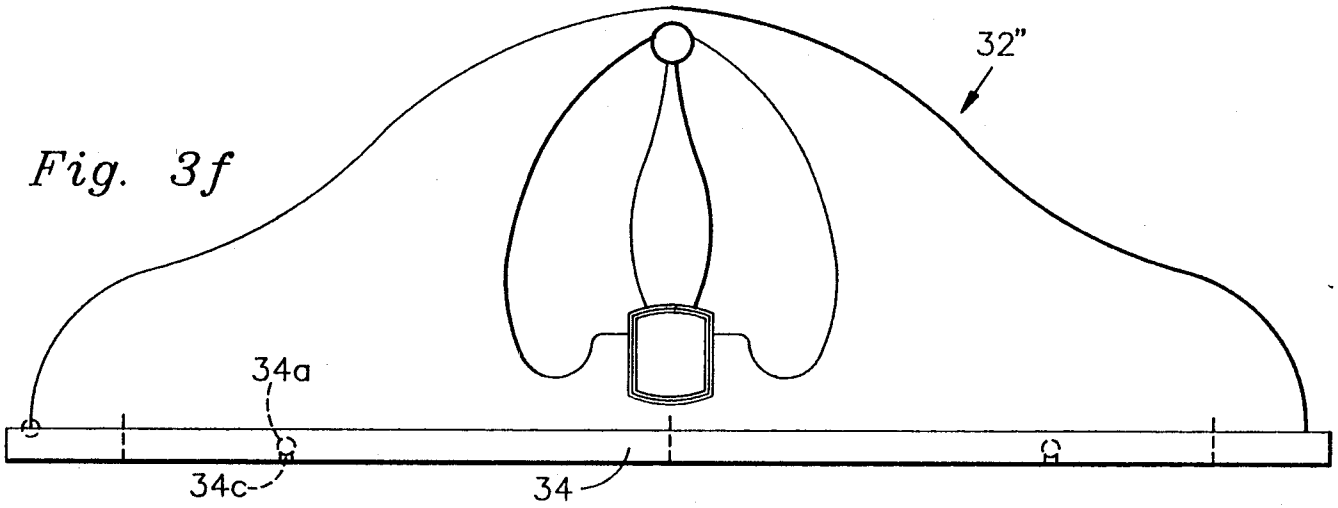
FIGS. 3*e* and 3*f* show elevational views of alternative motif designs.
Figure 3E:
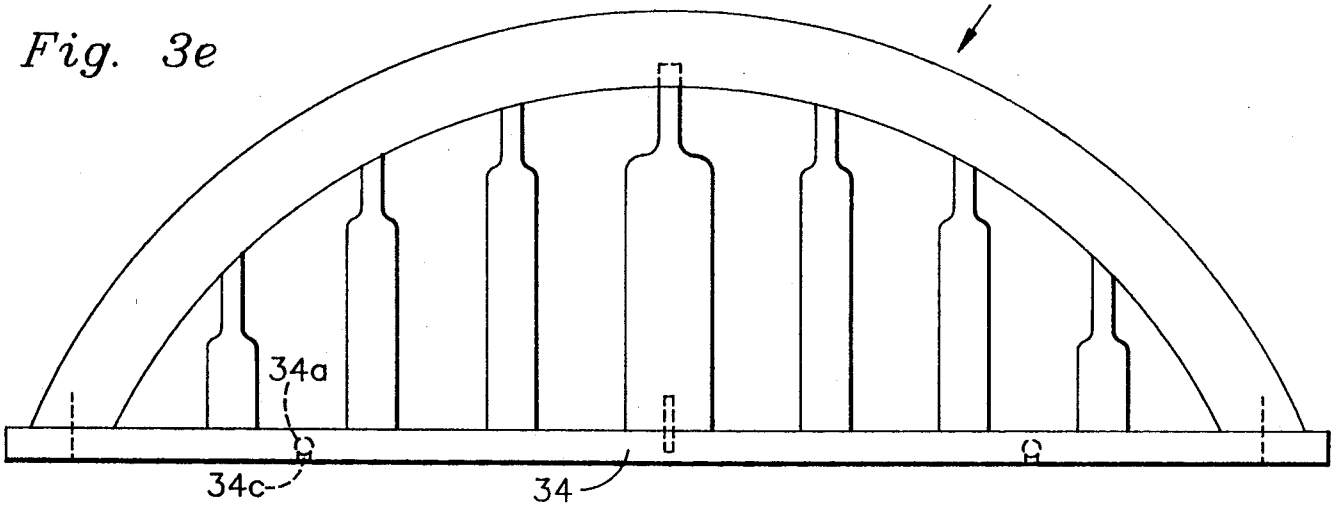

As was described hereinabove, the motif may provide anyone of a variety of different designs to suit the variety of different tastes with the common characteristic between the variety of different motifs being the structure of the top rail 35. FIGS. 3*e* and 3*f* show some of the different possible motif designs 32', 32'' which may be mounted upon the headboard and footboard assemblies in a simple, straightforward fashion.

The crib arrangement may be converted to a toddler bed by removing both the stationary and slidable crib rails shown in FIGS. 2*a* and 2*b*. The lower sections of the headboard and footboard assemblies are removed from the upper sections by twisting the cam locks to approximately one-quarter turn to unlock the cam locks from the cam stud. The upper section 12 may then be separated from the lower section 20. Panel 19 is also removed whereupon the bottom surface of each of the side posts 14, 14 of the upper section 12 serve as the supporting surface for the headboard. The headboard and the footboard are disassembled in a similar fashion.

The crib rails are replaced by a pair of toddler bed safety rails which are substantially identical in design and function. Hence, only one toddler safety rail will be described herein for purposes of simplicity.

Figure 4A:
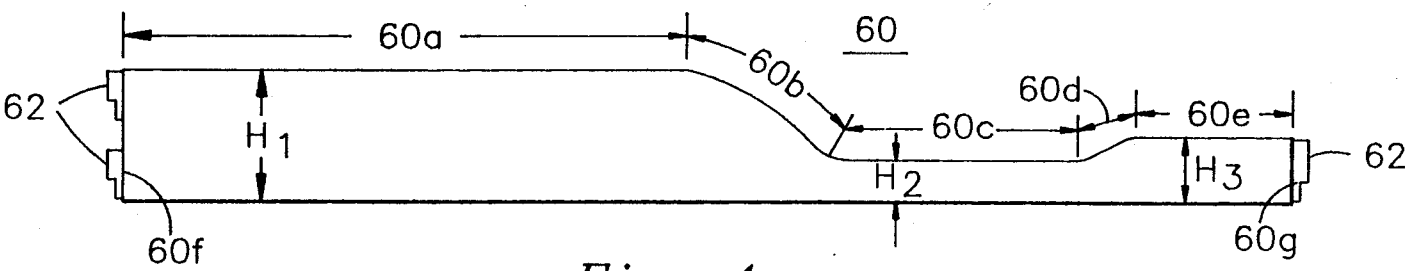
FIG. 4*a* shows a side view of a toddler safety rail.
Figure 4E:
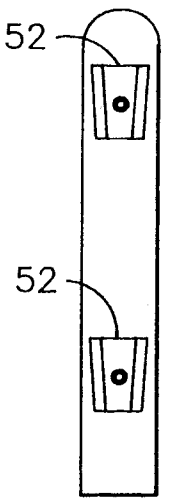
FIGS. 4*e* and 4*f* show end views of the toddler safety rail as it would be mounted to the side of the headboard and footboard assemblies adapted to receive the fixed safety toddler rail.

FIG. 4*a* shows a side view of one of the toddler rails 60 having a height H1 extending from the left-hand end thereof toward the center, having a height H2 joined to the section of height H1 by a curved portion 60*b*, the length 60*c* of the portion of height H2 being joined to an upwardly curved portion 60*d* to merge with a portion 60*e* of height H3. The side rail portion 60*a* of height H1 is placed near the head end of the bed. The section 60*c* being closer to the foot end of the bed and being of a reduced height, facilitates the climbing into and out of the bed by a toddler. It should be understood that the other side rail is mounted in a similar fashion. The section 60*a* of increased height serves as a side barrier to prevent the toddler from accidentally rolling out of bed.

Figure 4D:
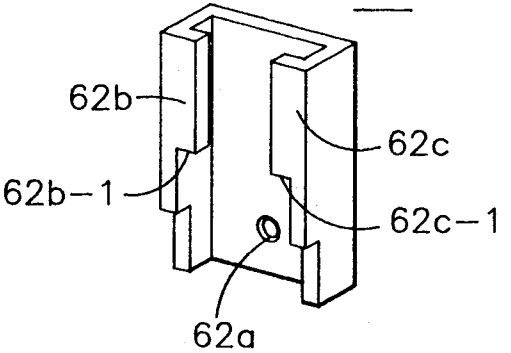
FIG. 4*d* shows a detailed perspective view of the slide shown in FIGS. 4*b* and 4*c*.
Figure 4F:
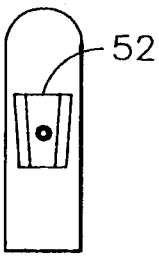
Figure 4C:
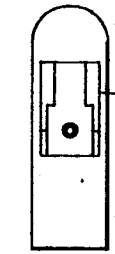
FIGS. 4*b* and 4*c* show end views of the toddler safety rail employed for mounting on the side of the headboard and footboard assemblies adapted to fit hardware already in place on the headboard and footboard assemblies.
Figure 4B:
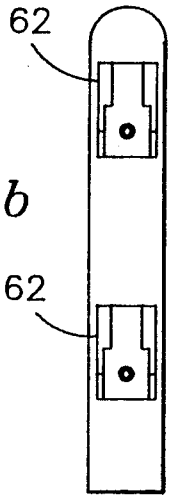

A pair of slides 62, 62 are secured to the left-hand end 60*f* of side rail 60. A similar slide 62 is secured to the right-hand end 60*g* of side rail 60. See FIGS. 4*b* and 4*c*. Slide 62 is shown in enlarged fashion in FIG. 4*d* and is provided with an opening 62*a* for receiving a threaded fastener for securing the slide to the toddler safety rail. A pair of inwardly directed flanges 62*b*, 62*c* cooperate with the upper tracks as will now be described in connection with FIG. 2*a*.

Once the drop side rail has been removed, the threaded fasteners extending through openings 29*b* are removed, the upper tracks are rotated to an angle of 180 degrees about the fastener extending through opening 29*c* so that the top of the upper tracks is now located at the bottom whereby the top of the track 29*a*-1 is now the bottom of the track and serves as a stop. With the upper tracks in the rotated position, the fasteners previously extending through the openings 29*b* are inserted through pre-drilled holes provided in the headboard and footboard end posts to secure the upper tracks 29, 29 in their inverted or "upside-down" orientation.

The upper and upper lower slides 62, 62 mounted on the left-hand end 60*f* of safety rail 60 are slidably received within the tracks 29*a* of upper guide 29. The shoulders 62*b*-1, 62*c*-1 of these flanges (see FIG. 4*d*) rest against the stop 29*a*-1. The flanges of the slide 62 mounted on the right-hand end 60*g* of toddler safety rail 60 likewise enter into the tracks 29*a* of the "upside-down" upper guide 29 and is arranged so that its shoulders 62*b*-1, 62*c*-1 engage stops 29*a*-1.

The toddler safety rail mounted on the side of the bed replacing the fixed crib side rail is fitted with a pair of male coupling members 52, 52 at the left-hand end 60*f* thereof and with a single male coupling member 52 at the right-hand end 60*g* thereof. The male coupling members 52 are substantially identical to the male coupling members 52 shown in FIG. 1*f*. These male coupling members have their flanges aligned with the female members which are secured to the end posts of the headboard and footboard opposite the end post receiving the slides 62. The female members are lowered to two pre-drilled holes along the end post to mount the toddler safety rail at the proper height. The toddler safety rail is then pressed down and locks into position. The coupling hardware described herein, together with the posture board mounting, provides a rugged toddler bed structure of superior structural strength. The posture board is raised preferably to the uppermost position by insertion of the posture board hooks 27*a*–27*d* into the uppermost slot within the cooperating post plates, as shown in FIG. 1*c*.

The conversion from the crib arrangement to the toddler bed arrangement is simple and easy to perform and requires no independent storage of any of the components. The toddler safety rails are releasably mounted upon the underside of the posture board by fabric straps S which are fastened to the posture board by screws S1, for example, to the underside of the Masonite board 18*e* and may be removed simply by removing the screws through the use of a screwdriver, for example. The slides 62 and 52 are all premounted to the toddler safety rails at the factory and the cooperating female members are already mounted to the end posts of the headboard and footboard assemblies thus avoiding the inconvenience of having to store hardware in a remote location and then attempting to remember where the stored hardware is located two or three years after the original purchase of the convertible bed arrangement. The hardware is self-locking providing a rugged toddler bed structure once assembled and is attractive from an aesthetic viewpoint and does not detract from the overall aesthetic appearance of the toddler bed.

At the appropriate time in the growth of the child, the toddler bed may be readily and simply converted to a full size, conventional twin bed by removing the toddler safety rails and the posture board assembly. The safety rails may be removed simply by lifting directly upwardly to lift the male assemblies out from their cooperating female members. The posture board is easily removed by lifting the hooks from the cooperating slots provided within the post plates shown, for example, in FIG. 1*c*. Thereafter, a pair of twin bed conversion pieces 66, 66 are mounted to the left and right-hand end posts 14, 14 of the upper section 12 of a headboard assembly 10, for example, as shown in FIG. 5*c*. The conversion piece 66 is comprised of a main body portion 66*a* curving at its upper end to form an outwardly projecting portion 66*b* and at its lower end to provide a projecting portion 66*c*. Drilled holes 66*f* and 66*g* each receive a head of a connecting bolt 68 mounted within a pre-drilled threaded opening provided in end post 14 shown, for example, in FIG. 5*d*. The enlarged rounded head portion 68*a* cooperates with a cam lock member substantially identical to the cam lock member 25 shown in FIG. 1*e* and which is inserted into opening 66*h* which communicates with and is aligned perpendicular to drilled hole 66*f*. A similar opening 66*i* cooperates with drilled hole 66*g*. The cam locks are twisted a quarter turn to lock conversion pieces 66, 66 to the headboard assembly 10 as shown in FIG. 5*c*.

The top edge of the conversion side pieces fits beneath the top rail 13 of the headboard assembly 10 while the bottom edge 66*j* is aligned with the bottom surface of the end posts 14, 14 as shown in FIG. 5*c*. The conversion pieces 66 thus serve as a structural support member for the twin bed. Each of the conversion side pieces is further provided with pre-drilled bolt holes 66*k*, 66*l* to receive bolts for bolting the twin bed side rails thereto. Noting, for example, FIG. 5*e*, one side rail 70 shown in broken fashion for simplicity, has one end coupled to conversion side piece 66 and its opposite end connected to conversion side piece 66'. Each side rail is provided with a conventional support with the supports of the two side rails cooperating to support a conventional spring and mattress. The conversion side pieces 66, when mounted to the headboard and footboard assemblies, provide a twin bed structure of the appropriate width for receiving and supporting conventional twin bed size mattresses and box springs. The ledges 72 on the rails 70 support a box spring and a mattress. FIG. 5*f* is a perspective view of an alternative rail comprised of an angle iron 74 having end plates 76, only one being shown for purposes of simplicity. Ledges 76*a* of the angle irons 74 support a box spring and mattress.

The components making up the convertible bed are rugged and provide a crib, toddler bed and twin bed structure each having excellent structural strength.

As another alternative to the twin bed structure described hereinabove, since the headboard and footboard assemblies are substantially identical, each of the assemblies may be utilized as a headboard to form a pair of twin beds having a headboard and no footboard. Each headboard is provided with pre-drilled holes which are adapted to receive a frame 80 (see FIG. 5*g*) having mounting plates 80*a*, 80*a* which are bolted onto the conversion pieces 66, 66 (see FIG. 5*c*). The frame has a cross-member 80*b* at the foot section as well as flanges 80*c*, 80*c* allowing for the support of the box spring and mattress thereby providing a convertible bed assembly which provides the additional flexibility of providing either a single twin bed or a pair of twin beds or a pair of bunk beds (i.e. two twin beds with and without footboards and a pair of bunk beds). Additional cross-pieces 82 may also be provided.

The lower section 20 of the headboard assembly 10 shown in FIG. 1 may be adapted to serve as a footboard assembly when combined with a footboard assembly conversion kit, enabling the two identical headboard assemblies utilized in the crib and toddler bed arrangements to be converted to a pair of twin beds each having a headboard assembly which utilizes the upper section 12 shown in FIG. 1 and a footboard assembly which utilizes the section 20 shown in FIG. 1. The conversion of upper section 12 into a headboard assembly for providing a pair of twin beds utilizes the conversion pieces 66 shown in FIGS. 5*a* and 5*b* to form a headboard assembly as shown in FIG. 5*c* (either with or without the motif).

Figure 5H:
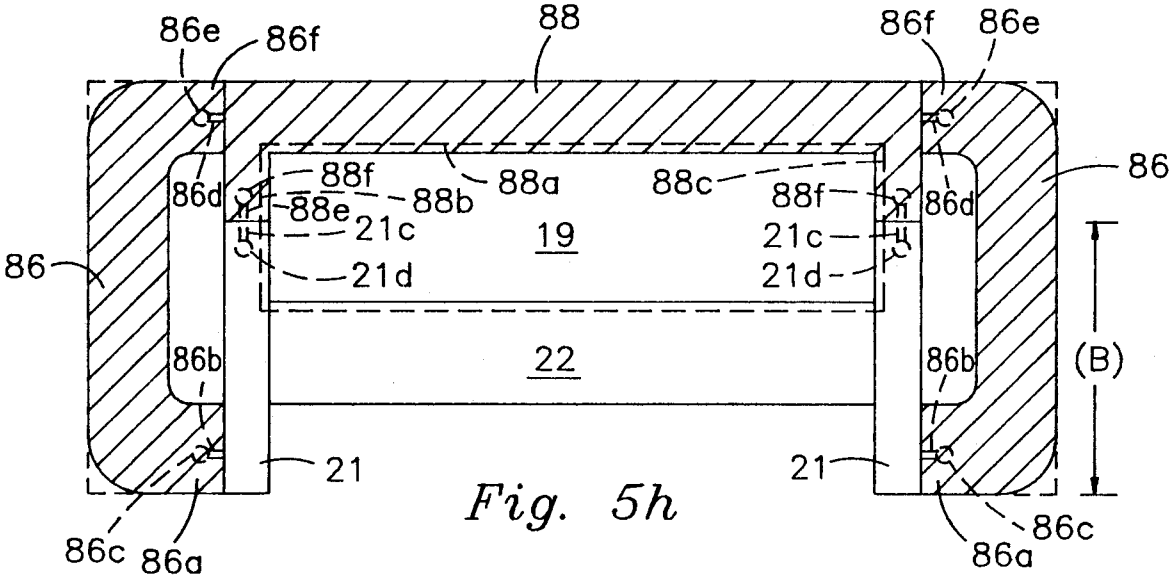
FIG. 5*h* is an elevation view which shows the manner in which the lower sections of the assembly of FIG. 1 is converted to a footboard to provide a pair of twin beds with headboards and footboards.
Figure 4G:
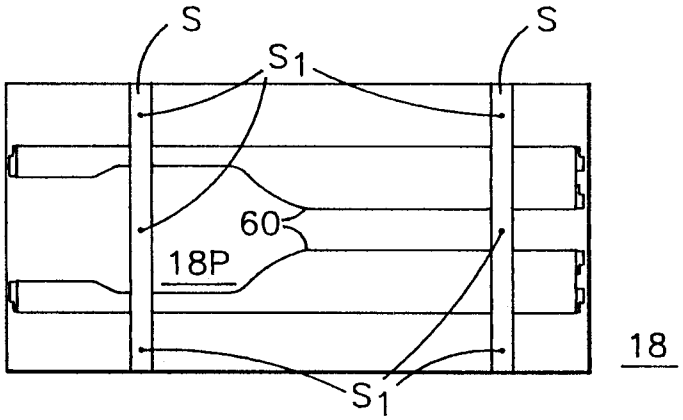
FIG. 4*g* is a plan view of the underside of the posture board assembly showing the manner in which the toddler safety rails are releasably mounted thereto.
Figure 5G:
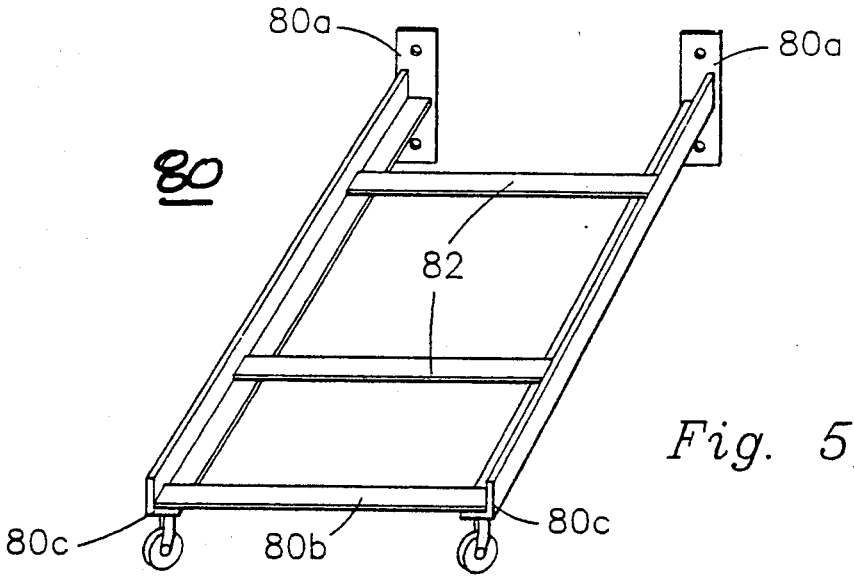
FIG. 5*g* is a perspective view of a preferred twin bed frame assembly.
Figure 5D:
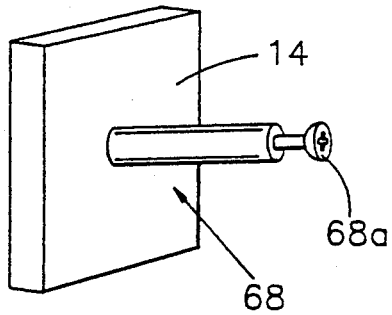
FIG. 5*d* shows a perspective view of the hardware used for mounting the twin bed conversion piece to the headboard and footboard assemblies.
Figure 5A:
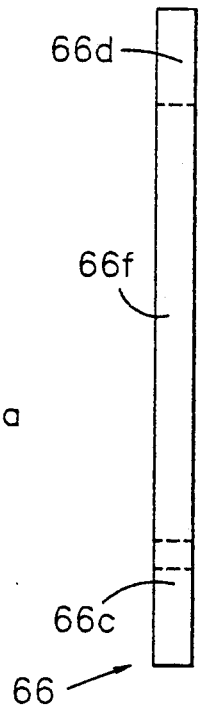
FIGS. 5*a* and 5*b* show side and end views of a twin bed conversion piece employed for converting the bed arrangement to a conventional twin bed.
Figure 5B:
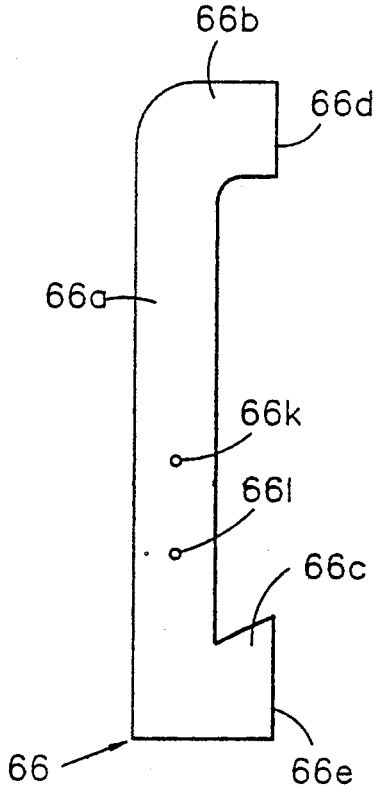
Figure 5C:
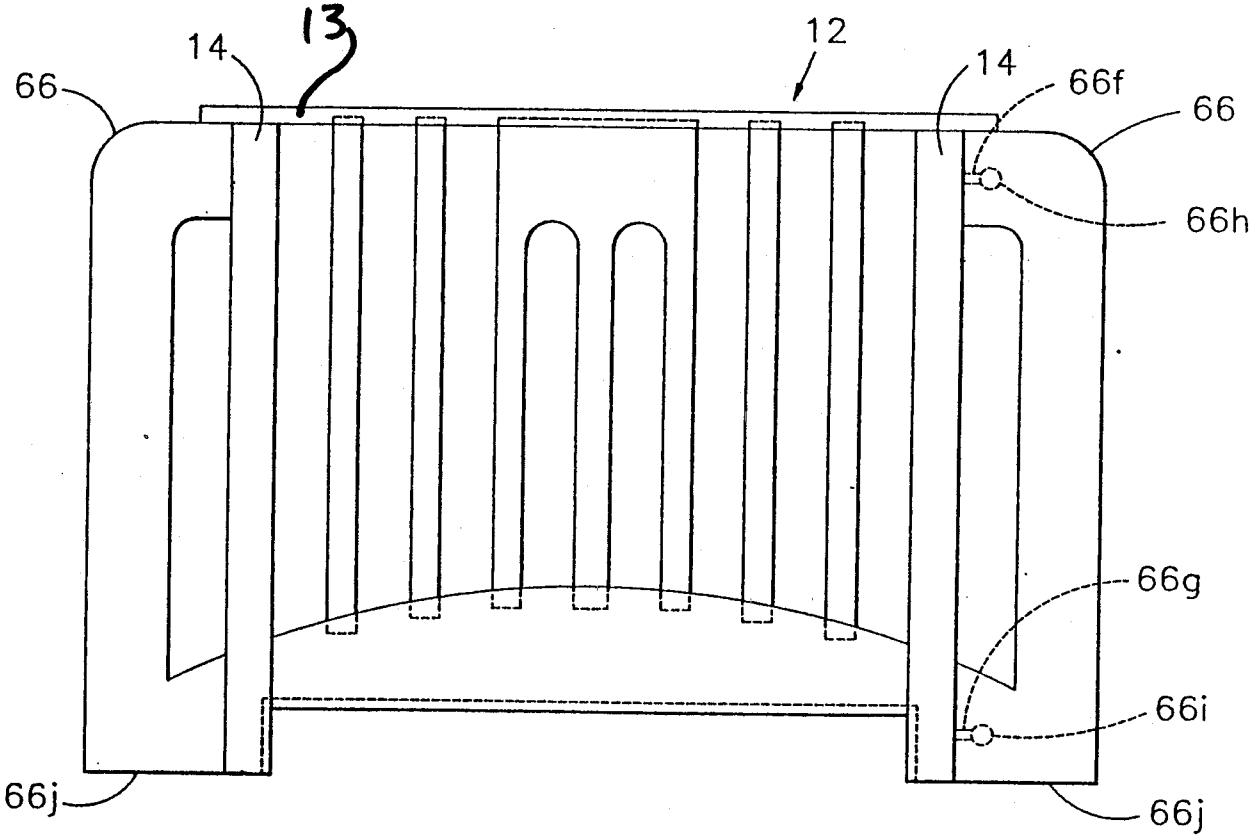
FIG. 5*c* shows a view of an assembled twin bed end.
Figure 5F:
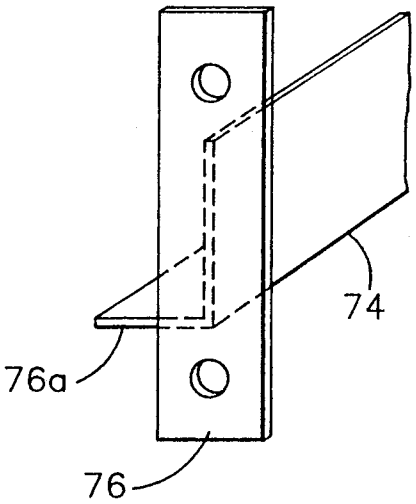
FIG. 5*f* is a perspective view showing a metal side rail.
Figure 5E:
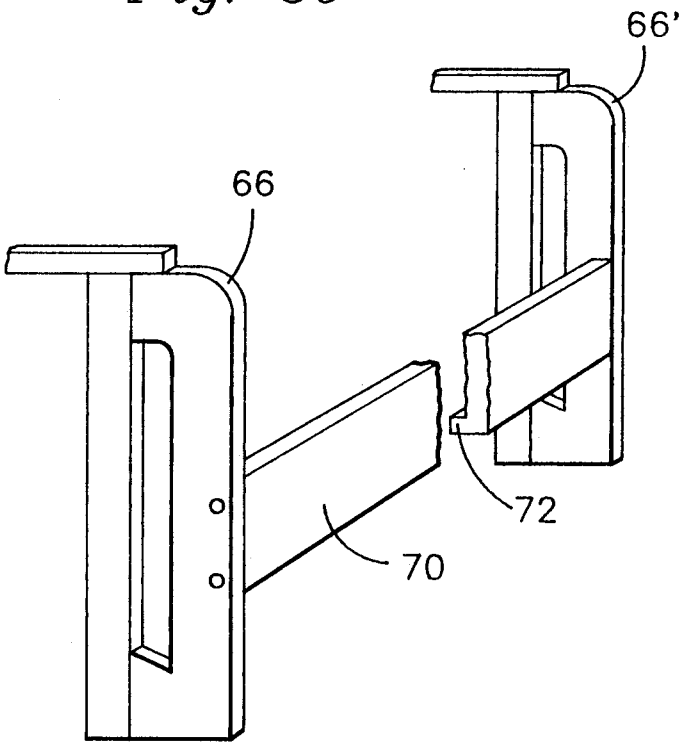
FIG. 5*e* is a perspective view showing the manner in which a wooden side rail is mounted to the twin bed conversion pieces.

The lower section 20 is converted to a footboard assembly in the manner shown in FIG. 5*h*. A pair of side conversion pieces 86, 86, which are substantially C-shaped, have their lower portions 86*a*, 86*a* joined to the lower portions of legs 21, 21 utilizing hardware similar to that shown in FIGS. 1*e* and 5*d*. The lower portions 86*a* are each provided with openings 86*b*, 86*c* substantially identical to the openings 66*g*, 66*i* provided in the twin bed conversion member 66 shown in FIG. 5*c*. A coupling member 68 see FIG. 5*d* is mounted to each of the legs 21, 21 so as to extend into one of the openings 86*b*. A cam lock 74 is positioned in each of the openings 86*c*, 86*c* and locks with the enlarged head 66*a* of member 68 to secure the lower end of conversion pieces 86, 86 to each of the legs 21, 21. Similar openings 86*d*, 86*e* are provided in the upper portions 86*f* of conversion pieces 86 and utilize similar hardware components 68 and 74 to secure the upper ends of the conversion pieces 86 to conversion piece 88 which is a substantially C-shaped member. Grooves 88*a*, 88*b* and 88*c* are provided along the interior surfaces of member 88 to receive the upper edge and the upper portions of the side edges of board 19 in the manner shown.

Openings 88*e*, 88*e* and 88*f*, 88*f* are provided in the downwardly depending portions of conversion piece 88 and cooperate with the openings 21*c*, 21*d* in each of the legs 21, 21 to join conversion piece 88 to legs 21, 21 through the use of the cam stud 23 shown in FIG. 1*e* and a pair of cam locks 74. Although not shown for purposes of simplicity, it should be understood that the footboard conversion pieces 86 and 88 are of a thickness substantially equal to the thickness of legs 21, 21.

Employing the conversion set of FIG. 5*h*, and the conversion set shown in FIG. 5*c*, it is thus possible to provide a pair of twin beds each with a headboard and a footboard assembly thereby utilizing all of the components of the headboard assembly employed in the crib and toddler bed arrangements.

Figure 5I:
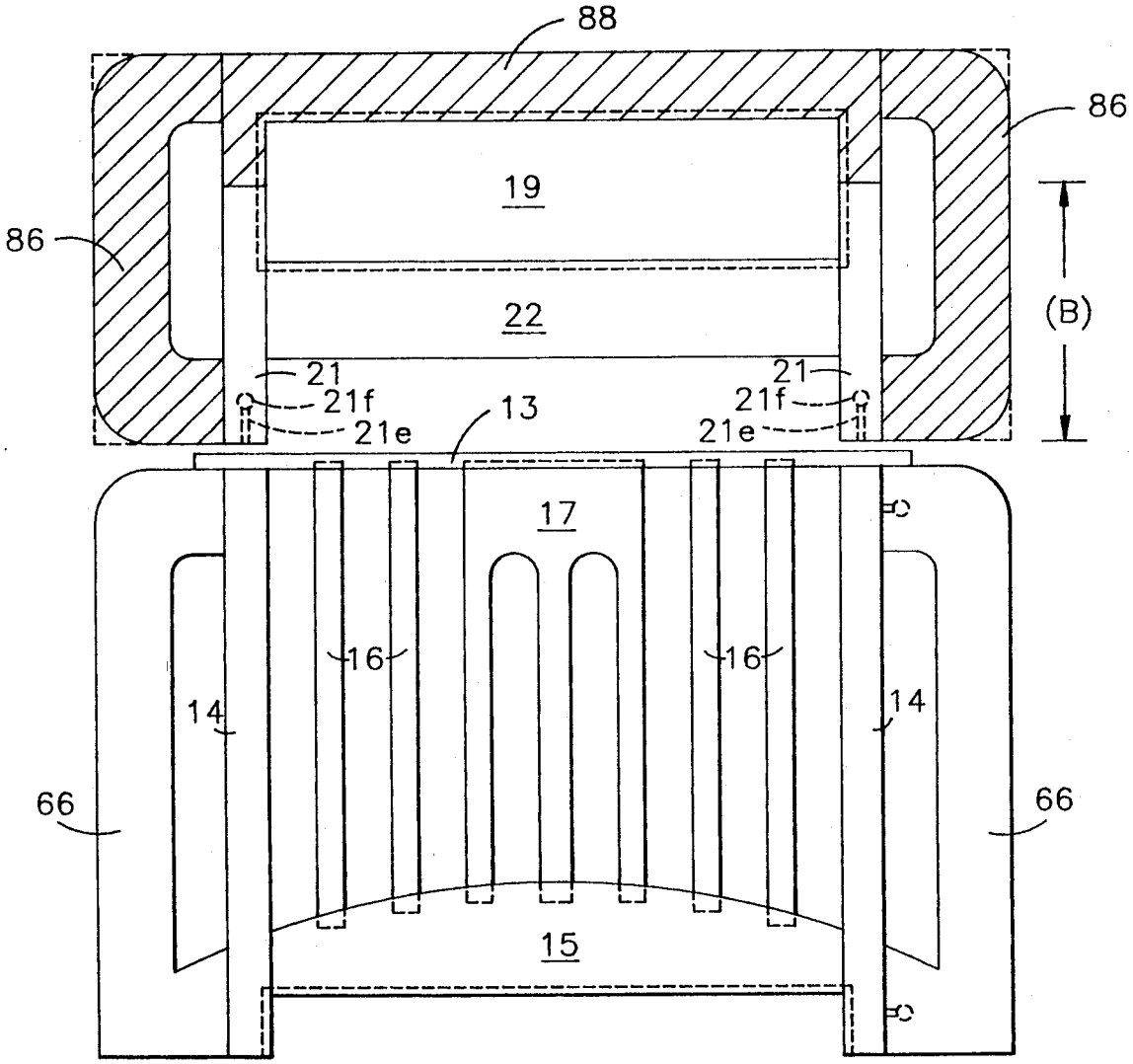
FIG. 5*i* is an elevational view showing a bunk bed arrangement.

The pair of twin beds may be converted into bunk beds by forming a first bed comprised of the upper sections 12 of the headboard assembly 10 to form a lower bed; by utilizing the converted footboard assemblies as shown in FIG. 5*h* to form a second bed which serves as the upper bed; and by mounting the upper bed upon the lower bed in the manner shown in FIG. 5*i*. The legs 21, 21 are each provided with openings 21*e*, 21*f* for utilization of hardware, such as, for example, the cam locks 74 which are arranged in openings 21*f* and the cam stud 68 shown, for example, in FIG. 5*d*. This arrangement provides adequate head room between the lower bunk bed and the bottom of the upper bunk bed and fully utilizes all of the components of the headboard assembly employed in both the crib and toddler bed arrangements.

Any of the twin bed arrangements described hereinabove are designed to accommodate a trundle bed (not shown for purposes of simplicity) which is typically comprised of a low profile bed arranged on casters to slide beneath the twin bed or the lower bunk bed, for example. Adequate room is provided to receive the trundle bed by positioning the pre-drilled holes utilized to receive the twin bed side rails at a height sufficient to provide adequate clearance for the trundle bed.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A convertible bed arrangement comprising:

a pair of end assemblies respectively serving as headboard and footboard assemblies;

each of said assemblies comprising an upper and a lower section releasably joined to one another by suitable fastening means for forming a crib arrangement;

each of said headboard and footboard assemblies being provided with first and second coupling means for respectively coupling a fixed crib side rail and a drop side crib side rail thereto to form a crib arrangement;

first and second pairs of twin bed conversion pieces adapted to be arranged along opposite lateral sides of each of said headboard and footboard assemblies to laterally extend a width of said headboard and footboard;

said headboard and footboard assemblies each being provided with pre-drilled openings for receiving fastening means for coupling the twin bed conversion pieces to the sides of said headboard and footboard assemblies;

said headboard and footboard assembly lower sections being removable for converting to either a toddler bed or twin bed arrangement.

2. The apparatus of claim 1 further comprising:

a pair of toddler safety rails;

coupling means provided along the opposite ends of said toddler safety rails and adapted to be respectively slidably inserted within said first and second coupling means mounted upon said headboard and footboard assemblies for releasably securing the toddler safety rails to the upper sections of said headboard and footboard assemblies.

3. The apparatus of claim 2 further comprising:

a rectangular-shaped posture board for supporting a mattress for use with any one of the crib or toddler bed arrangements;

said toddler bed safety rails being releasably mounted to the underside of said posture board and thereby concealed from view for temporary storage of the toddler safety rails when the convertible bed arrangement is used as a crib arrangement.

4. The apparatus of claim 3 wherein said toddler rails are retained on the underside of said posture board by straps overlying the safety rails and secured to the posture board by removable threaded fastening means.

5. The apparatus of claim 5 further comprising:

a pair of post plates mounted to each of said headboard and footboard assemblies;

each of said post plates being provided with a plurality of spaced hook-receiving slots;

the corners of said posture board being provided with mounting hooks each being adapted for insertion into one of said hook receiving slots in an associated one of said post plates, the number of slots being provided in each of the post plates to provide for a plurality of height adjustments for the posture board and hence the mattress.

6. The apparatus of claim 1 further comprising:

a pair of frame assemblies and means for respectively mounting said frame assemblies to the upper sections of each of said headboard and footboard assemblies to form a pair of twin beds.

7. The apparatus of claim 1 wherein said posture board is of a size to accommodate a conventional crib mattress.

8. The apparatus of claim 7 wherein said headboard and footboard assemblies, when combined with said twin bed conversion piece and said side rails provide a bed size adapted for receiving a box spring and mattress of conventional twin bed size.

9. The apparatus of claim 1 wherein each of said headboard and footboard assemblies is provided with an elongated top rail;

a pair of motif members each arranged to be mounted to one of said top rails; and coupling means for releasably securing a motif to its associated top rail.

10. The apparatus of claim 9 wherein said top rail is provided with a pair of bolt holes;

said motif having a bottom rail and a motif member secured thereto;

said bottom rail having a pair of bolt hole openings each aligned with a bolt hole opening in the associated top rail;

said motif bottom rail further being provided with cross-dowel openings each communicating with one of said bolt hole openings and having a longitudinal axis perpendicular to the longitudinal axes of the bolt hole openings in said bottom rail;

a cross-dowel member being inserted into each cross-dowel opening and having a cylindrical shape conforming to the shape of said opening and having a threaded opening aligned so that its central axis is perpendicular to the longitudinal axis of the cylindrical-shaped member for threadedly engaging the threaded bolt extending through said headboard and footboard assembly top rails and the motif bottom rails.

11. The apparatus of claim 1 wherein said upper and lower sections of said headboard and footboard assemblies are each provided with a pair of end posts;

the end posts of said upper section having pre-drilled openings at their lower ends and the end posts of said lower section having pre-drilled openings at their upper ends adapted to be aligned with the pre-drilled openings in the upper section end posts;

each of said end posts having communicating openings extending in a direction perpendicular to said first-mentioned openings and communicating therewith;

said aligned openings receiving a double-headed connecting member having an enlarged head portion at each end;

said communicating openings each receiving a corner cam for interlocking with an associated one of the enlarged heads of said connecting member for releasably securing the upper and lower sections to one another.

12. The apparatus of claim 1 wherein said headboard and footboard assemblies are each comprised of upper and lower sections each having a pair of end posts and a cross-piece, a portion of said end post and said cross-pieces being provided with recesses for receiving the marginal edges of a substantially planar filler board inserted therein and being secured in position between said upper and lower sections when said upper and lower sections are joined to one another.

13. The apparatus of claim 1 wherein the crib arrangement drop side rail assembly further includes upper guide means mounted upon said headboard and footboard assemblies and having guide tracks;

the upper end of said guide tracks having a stop;

guide flange means provided at opposite upper ends of the drop side crib rail and being slidable within the tracks of an associated one of said upper guide means;

lower guide means being mounted to said headboard and footboard assemblies at positions therealong below said upper guide tracks and each having a locking notch;

follower means mounted on the lower ends of said drop side crib rail and being slidably guided by an associated one of said lower guide means;

said lower guide follower means further including bias means for urging said guide follower means into said locking notch when said lower guide follower means is aligned with said locking notch, thereby locking the drop side crib rail assembly in the upper position.

14. The apparatus of claim 13 wherein said upper guide rails are mounted to said headboard and footboard assemblies by upper and lower fastening means;

said headboard and footboard assemblies being further provided with pre-drilled holes each located on said headboard and footboard assemblies at positions below the positions of said lower fastening means whereby removal of said upper fastening means and rotation of said upper guide means through a half-revolution and insertion of said upper fastening means into said pre-drilled holes located beneath said lower fastening means inverts the position of the upper guide stops;

the toddler safety rail being mounted on the side of said convertible bed assembly adapted to slidably support the drop side crib rail assembly being provided with slides for engagement with said upper guide means, said toddler safety rail being properly positioned when said slides engage the inverted guide stop.

15. The apparatus of claim 14 wherein the toddler rail adapted to replace the fixed crib side rail is provided with male coupling members on opposite ends thereof;

said coupling means on said headboard and footboard assemblies comprising female coupling means which are moved to a lower set of pre-drilled holes provided in said side posts and slidably receive an associated one of said male coupling means for mounting the toddler safety rail to said headboard and footboard assemblies.

16. The apparatus of claim 1 wherein all of the components for forming a crib arrangement are housed within a first carton;

the components adapted to be coupled to said headboard and footboard assemblies for forming the twin bed arrangement being housed within a second carton smaller than said first carton.

17. The apparatus of claim 16 wherein said second carton is housed within said first carton.

18. The apparatus of claim 17 wherein a motif and a mounting means for mounting the motif to said headboard and footboard assemblies are arranged within a third carton independent of said first and second cartons.

19. The apparatus of claim 1 further comprising:

first conversion means coupled to the upper sections of said headboard and footboard assemblies for forming a first bed;

second conversion means coupled to the lower sections of said headboard and footboard assemblies for forming a second bed;

said second bed being positioned upon said first bed; and fastening means for coupling said first and second beds.

20. The apparatus of claim 1 further comprising conversion means for converting each lower section into a twin bed footboard assembly for use in a twin bed.

21. The apparatus of claim 20 further comprising side rails coupled between one of said twin bed footboard assemblies to one of the headboard twin bed assemblies to form a twin bed for supporting a conventional twin bed box spring and mattress.

22. The apparatus of claim 1 further comprising:

a pair of side rails for supporting a box spring and a mattress;

each of said twin bed conversion pieces being provided with pre-drilled openings;

fastening means extending through said pre-drilled openings in said twin bed conversion pieces for coupling said side rails to said headboard and footboard assemblies.

23. The apparatus of claim 22 wherein said twin bed conversion pieces are each of a size cooperating with the headboard assemblies to space the side rails to support a box spring and mattress, said box spring and mattress being of the conventional twin bed size.

24. The apparatus of claim 22 further comprising a pair of twin bed frame means each being respectively coupled to the upper sections of the headboard assembly and the footboard assembly to provide a pair of twin beds.

25. The apparatus of claim 22 further comprising a pair of twin bed frame means each being respectively coupled to the upper and lower sections of said headboard and footboard assemblies to form a pair of twin beds, the upper and lower sections of said headboard and footboard assemblies respectively serving as a headboard and a footboard of each twin bed.

26. The apparatus of claim 25 wherein said twin bed frame means comprises twin bed footboard conversion means for converting each lower section into a footboard of a width sufficient to accommodate a conventional twin bed size box spring and mattress.

27. The apparatus of claim 26 wherein said twin bed footboard conversion means comprises a pair of members joined to sides of said lower section by releasable fastening means and supports a pair of side rails which are spaced apart by a distance sufficient to support a conventional twin bed box spring and mattress.

* * * * *

UNITED STATES PATENT AND TRADEMARK OFFICE

CERTIFICATE OF CORRECTION

PATENT NO. : 5,146,631

DATED : September 15, 1992

INVENTOR(S) : Harry Deal

It is certified that error appears in the above-identified patent and that said Letters Patent is hereby corrected as shown below:

COLUMN 8

Line 60, change "18a" to read --18c--

Line 59, change "18c-18d." to read --18a-18d--.

Signed and Sealed this

Ninth Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,146,631

DATED : September 15, 1992

INVENTOR(S) : Harry Deal

It is certified that error appears in the above-identified patent and that said Letters Patent is hereby corrected as shown below:

COLUMN 15

Line 35, after "footboard" add --assemblies--

Line 66, change "claim 5" to --claim 3"

Signed and Sealed this

Twenty-first Day of December, 1993

*Attest:*

*Attesting Officer*

BRUCE LEHMAN

*Commissioner of Patents and Trademarks*